US005246805A

United States Patent [19]

Miyazaki et al.

[11] Patent Number: 5,246,805

[45] Date of Patent: Sep. 21, 1993

[54] ELECTROPHOTOGRAPHIC PHOTOSENSITIVE MEMBER, AND ELECTROPHOTOGRAPHIC APPARATUS AND FACSIMILE EMPLOYING THE SAME

[75] Inventors: Hajime Miyazaki; Toshihiro Kikuchi; Yoshio Kashizaki, all of Yokohama, Japan

[73] Assignee: Canon Kabushiki Kaisha, Tokyo, Japan

[21] Appl. No.: 704,212

[22] Filed: May 22, 1991

[30] Foreign Application Priority Data

May 24, 1990 [JP] Japan ..... 2-132676

[51] Int. Cl.[5] ..... G03G 15/02; G03G 15/06; G03G 15/00; C07C 245/00

[52] U.S. Cl. ..... 430/57; 430/56; 430/71; 430/72; 534/560

[58] Field of Search ..... 430/56, 57, 70, 71, 430/72, 75; 534/560

[56] References Cited

U.S. PATENT DOCUMENTS 5,047,304 9/1991 Miyazaki et al. ..... 430/73

FOREIGN PATENT DOCUMENTS 54-22834 2/1979 Japan .
60-131539 7/1985 Japan .
61-215556 9/1986 Japan .
61-241763 10/1986 Japan .
63-158561 7/1988 Japan ..... 430/72

OTHER PUBLICATIONS

Patent Abstracts of Japan, vol. 12, No. 427, Nov. 11, 1988, [P-784] (3274) (JPA 63-158561).

*Primary Examiner*—Marion E. McCamish
*Assistant Examiner*—Stephen Crossan
*Attorney, Agent, or Firm*—Fitzpatrick, Cella, Harper & Scinto

[57] ABSTRACT

An electrophotographic photosensitive member comprises an electroconductive support and a photosensitive layer formed thereon. The photosensitive layer contains a compound represented by the general formula:

(1)

The compound provide an electrophotographic photosensitive member which has excellent sensitivity and potential stability.

8 Claims, 1 Drawing Sheet

ELECTROPHOTOGRAPHIC PHOTOSENSITIVE MEMBER, AND ELECTROPHOTOGRAPHIC APPARATUS AND FACSIMILE EMPLOYING THE SAME

BACKGROUND OF THE INVENTION

1. Field of the Invention

The present invention relates to an electrophotographic photosensitive member, more particularly to an electrophotographic photosensitive member comprising a photosensitive member containing a disazo pigment having a specified chemical structure. The present invention also relates to an electrophotographic apparatus and a facsimile employing the photosensitive member.

Related Background Art

Known organic photoconductive substances used for electrophotographic photosensitive members include photoconductive polymers typified by poly-N-vinylcarbazole, low-molecular organic photoconductive substances like 2,5-bis(p-diethylaminophenyl)-1,3,4-oxadiazole, combinations of such organic photoconductive substances with a variety of dyes and pigments, and so forth.

Electrophotographic photosensitive members employing an organic photoconductive substance have advantages that the photoconductive members are able to produced at high productivity at low cost, and the color sensitivity thereof is arbitrarily controlled by selecting the employed sensitizer such as a dye and a pigment. Therefore, organic photoconductive substances have comprehensively been investigated. Recently, function separation types of photosensitive members have been developed which have a lamination structure comprising layers of a charge-generating layer containing an organic photoconductive dye or pigment and a charge-transporting layer containing aforementioned photoconductive polymer or a low-molecular organic electroconductive substance, whereby the disadvantage of conventional organic electrophotographic photosensitive members such as low sensitivity and low durability have been remarkably alleviated.

Among organic photoconductive substances, most azo pigments, generally, have superior photoconductivity. Moreover, selection of combinations of an azo component and a coupler component enables control of pigment properties, giving relatively easily a variety of properties of pigment compounds. Accordingly, many azo compounds have been reported as organic photoconductive substances, for example, in Japanese Patent Application Laid-Open Nos. 54-22834, 60-131539, 61-215556, 61-241763, 63-158561, etc.

Recently, with demand for higher picture quality, an organic photoconductive substance is sought which is capable of providing an electrophotographic photosensitive member having high sensitivity and higher potential stability.

SUMMARY OF THE INVENTION

An object of the present invention is to provide an electrophotographic photosensitive member comprising a photosensitive layer containing a novel photoconductive material.

Another object of the present invention is to provide an electrophotographic photosensitive member having high sensitivity and stable potential characteristics particularly in repeated use.

A still another object of the present invention is to provide an electrophotographic apparatus employing the above-mentioned electrophotographic photosensitive member.

A further object of the present invention is to provide a facsimile apparatus employing the above-mentioned electrophotographic photosensitive member.

According to an aspect of the present invention, there is provided an electrophotographic photosensitive member comprising an electroconductive support and a photosensitive layer formed thereon, the photosensitive layer containing a compound represented by the general formula (1) below:

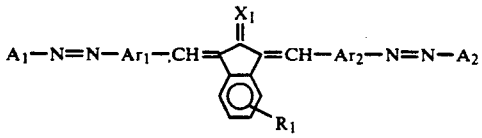

(1)

wherein $Ar_1$ and $Ar_2$, which may be the same or different, are each a substituted or unsubstituted carbocyclic aromatic group or a substituted or unsubstituted heterocyclic aromatic group; $X_1$ is sulfur or dicyanomethylene; $R_1$ is hydrogen, halogen, nitro, cyano, or a group of alkyl, aryl, aralkyl, alkoxy or aryloxy, which may be substituted; $A_1$ and $A_2$, which may be the same or different, are each a coupler residue having a phenolic hydroxyl group.

According to another aspect of the present invention, there is provided an electrophotographic apparatus employing the electrophotographic photosensitive member specified above.

According to still another aspect of the present invention, there is provided a facsimile apparatus employing the electrophotographic photosensitive member specified above.

DESCRIPTION OF THE PREFERRED EMBODIMENT

Figure 1:
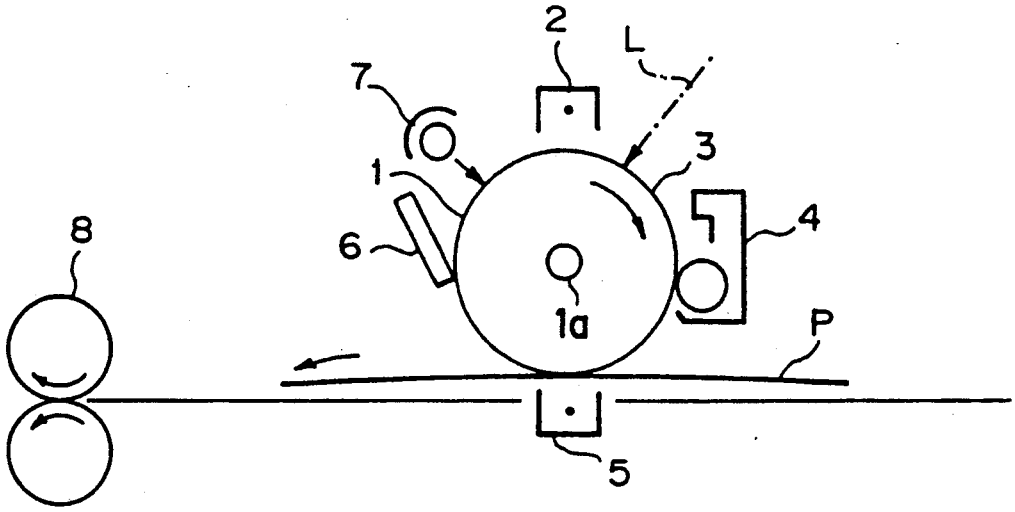
FIG. 1 illustrates outline of the constitution of an electrophotographic apparatus employing the electrophotographic photosensitive member of the present invention.

The photosensitive member of the present invention comprises an electrophotographic photosensitive layer containing a compound represented by the general formula (1) shown above.

In the formula (1), $Ar_1$ and $Ar_2$ are each a divalent group derived by eliminating two hydrogen atoms from a carbocyclic aromatic nucleus such as benzene, napthalene, anthracene, and the like or derived by eliminating two hydrogen atoms from a heterocyclic aromatic nucleus such as furan, pyrrol carboxylic acid, thiophene, pyridine, pyrazine, and the like. The substitutent which may be incorporated in $Ar_1$ and $Ar_2$ includes halogen atoms such as fluorine, chlorine, iodine, and bromine; alkyl groups such as methyl, ethyl, propyl, isopropyl, butyl, and the like; alkoxy groups such as methoxy, ethoxy, propoxy, and the like; aryloxy groups such as phenoxy and the like; a nitro group, a cyano group, and substituted amino groups such as dimethylamino, dibenzylamino, diphenylamino, morpholino, piperidino, and the like. The groups $Ar_1$ and $Ar_2$ may be the same or different.

The group $R_1$ includes alkyl groups such as methyl, ethyl, n-propyl, isopropyl, n-butyl, sec-butyl, tert-butyl, and the like; aryl groups such as phenyl, naphthyl, and the like; aralkyl groups such as p-tolyl, benzyl, phenethyl, naphthylmethyl, and the like; alkoxy groups such as methoxy, ethoxy, propoxy, and the like; and aryloxy groups such as phenoxy, and the like. The substituent which may be incorporated in the group $R_1$ includes halogen atoms such as fluorine, chlorine, iodine, and bromine; alkyl groups such as methyl, ethyl, propyl, isopropyl, butyl, and the like (excluding the cases where $R_1$ is an alkyl group); alkoxy groups such as methoxy, ethoxy, propoxy, and the like; aryloxy groups such as phenoxy (excluding the cases where $R_1$ is alkoxy or aryloxy); a nitro group, a cyano group, and substituted amino groups such as dimethylamino, dibenzylamino, diphenylamino, morpholino, piperidino, pyrrolidino, and the like.

Preferable examples of $A_1$ and $A_2$ are the coupler residues shown by Formulas (2) to (8).

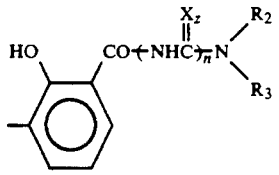

(2)

$Y_1$
(n = 0 or 1)

In Formula (2), $Y_1$ is a group of atoms for forming a condensed polycyclic aromatic ring such as a naphthalene ring, and an anthracene ring, or a heterocyclic ring such as a carbazole ring, benzocarbazole ring, a dibenzofuran ring, a dibenzonaphthofuran ring, a diphenylene sulfide ring and the like. The more preferable rings formed by $Y_1$ together with the benzene ring are a naphthalene ring, anthracene ring, a carbazole ring, or a benzocarbazole ring.

$X_2$ is oxygen or sulfur. The groups $R_2$ and $R_3$ may be the same or different and are each hydrogen, or a substituted or unsubstituted group of alkyl, aryl, aralkyl, or a heterocyclic group, or $R_2$ and $R_3$ may be linked to form a cyclic amino group together with the nitrogen in the formula. Herein, the alkyl group includes methyl, ethyl, propyl, butyl, and the like. The aryl group includes phenyl, diphenyl, naphthyl, anthryl, and the like. The aralkyl group includes benzyl, phenethyl, naphthylmethyl, and the like. The heterocyclic group includes a monovalent group derived by removing a hydrogen atom from a heterocyclic ring such as carbazole, dibenzofuran, benzimidazolone, benzothiazole, thiazole, pyridine and the like. The cyclic amino group includes the groups derived by removing a hydrogen linked to the nitrogen from piperidine, morpholine, pyrrolidine, pyrrol, carbazole, indole, phenothiazine, and the like.

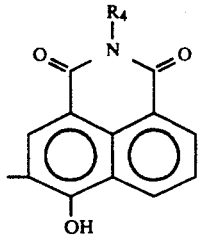

(3)

In Formula (3), $R_4$ is a substituted or unsubstituted group of alkyl, aryl, or aralkyl. The specific examples thereof are the same as those mentioned for $R_2$ and $R_3$ above.

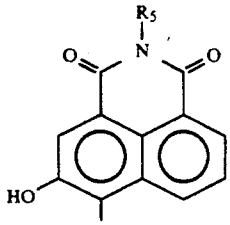

(4)

In Formula (4), $R_5$ is a substituted or unsubstituted group of alkyl, aryl, or aralkyl. The specific examples thereof are the same as those mentioned for $R_2$ and $R_3$ above.

In Formulas (2) to (4), the substituent by which aryl, aralkyl and heterocyclic ring represented by $R_2$, $R_3$, $R_4$, and $R_5$ may be substituted includes a halogen atom such as fluorine, chlorine, iodine, and bromine; an alkyl group such as methyl, ethyl, propyl, isopropyl, butyl, and the like (excluding the case where when $R_2$–$R_5$ are an alkyl group); an alkoxy group such as methoxy, ethoxy, propoxy, and the like; aryloxy groups such as phenoxy and the like; a nitro group, a cyano group, and a substituted amino group such as dimethylamino, dibenzylamino, diphenylamino, morpholino, piperidino, pyrrolidino, and the like.

$Z_1$

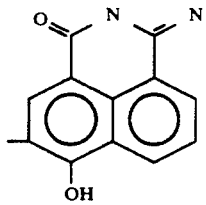

(5)

In Formula (5), $Z_1$ is a divalent aromatic hydrocarbon group, including divalent a monocyclic aromatic hydrocarbon radical such as o-phenylene and the like; a divalent polycyclic aromatic hydrocarbon such as o-naphthalene peri-naphthalene 1,2-anthralene, 9,10-phenanthralene and the like; and a divalent group for forming a heterocylic ring together with the two nitrogen atoms in the formula, such as 3,4-pyrazoldiyl, 2,3-pyridindiyl, 4,5-pyrimidindiyl, 6,7-indazoldiyl, 6,7-quinolindiyl, and the like.

$Z_2$ (6)

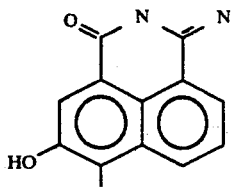

In Formula (6), the group $Z_2$ denotes the same group as $Z_1$ above.

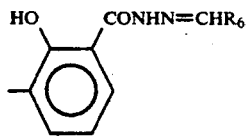

$Y_2$ (7)

In Formula (7), the group $R_6$ is a substituted or unsubstituted aryl or a substituted or unsubstituted heterocyclic ring group, specifically including the groups of phenyl, naphthyl, anthryl, pyrenyl, pyridyl, thienyl, furyl, carbazolyl, and the like. The substituent which may be incorporated therein includes a halogen atom such as fluorine, chlorine, iodine, and bromine; an alkyl group such as methyl, ethyl, propyl, isopropyl, butyl, and the like; an alkoxy group such as methoxy, ethoxy, propoxy, and the like; an aryloxy group such as phenoxy; a nitro group, a cyano group, and substituted amino groups such as dimethylamino, dibenzylamino, diphenylamino, morpholino, piperidino, and the like. The group $Y_2$ denotes the same one as $Y_1$ in the Formula (2).

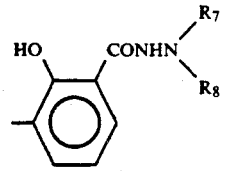

$Y_3$ (8)

In Formula (8), $R_7$ and $R_8$ may be the same or different, and are each a group of alkyl, aryl, aralkyl, or heterocyclic ring. Specifically, $R_7$ and $R_8$ denote the same groups as $R_2$ and $R_3$. $Y_3$ is the same as $Y_1$ in Formula (2).

Specific examples of the compounds represented by Formula (1) are shown below without limiting the invention thereto. Those compounds are shown firstly by the general formula and then designated by the variable portions of the general formula.

Basic Structure 1

-continued

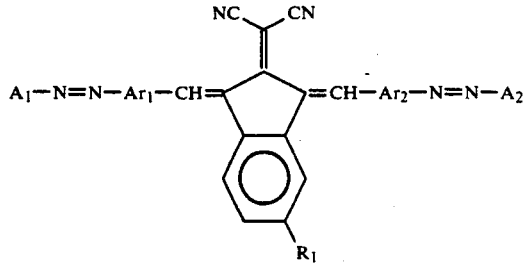

(1)

Exemplified pigment (1)

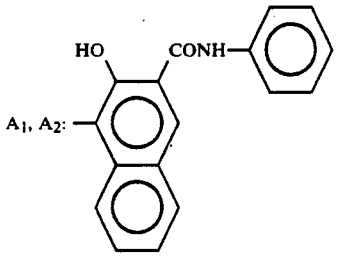

$R_1$: —H

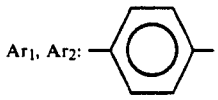

Exemplified pigment (2)

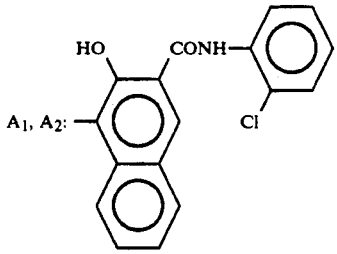

$R_1$: —H

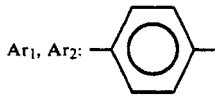

Exemplified pigment (3)

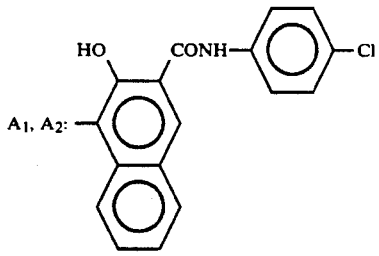

$R_1$: —$OCH_3$

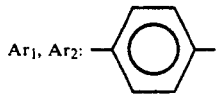

Exemplified pigment (4)

-continued
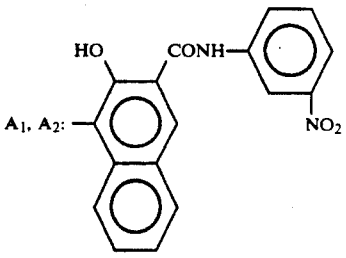
$R_1$: $-NO_2$
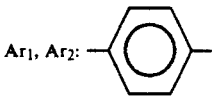
Exemplified pigment (5)
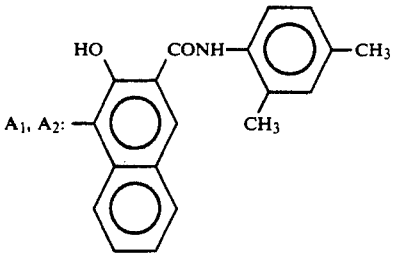
$R_1$: $-NO_2$
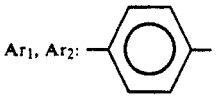
Exemplified pigment (6)
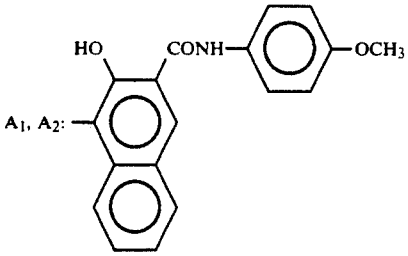
$R_1$: $-NO_2$
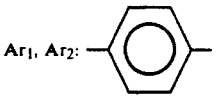
Exemplified pigment (7)
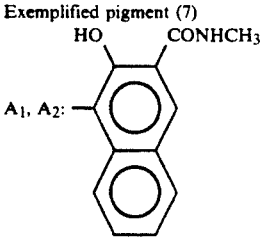
$R_1$: $-NO_2$
-continued
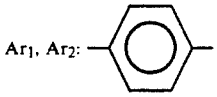
Exemplified pigment (8)
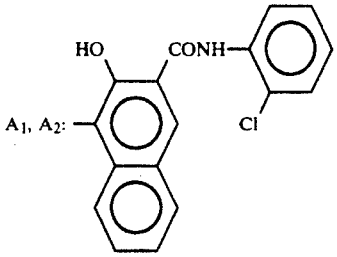
$R_1$: $-Cl$
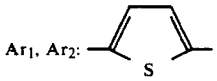
Exemplified pigment (9)
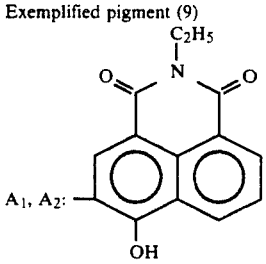
$R_1$: $-H$
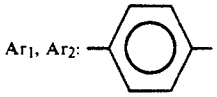
Exemplified pigment (10)
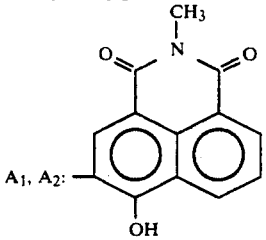
$R_1$: $-CN$
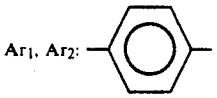
Exemplified pigment (11)
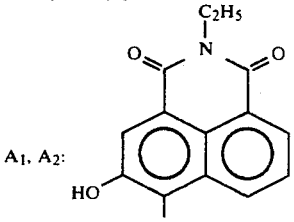

-continued
$R_1$: —H
$Ar_1$, $Ar_2$:
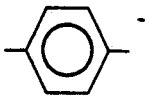
Exemplified pigment (12)
$A_1$, $A_2$:
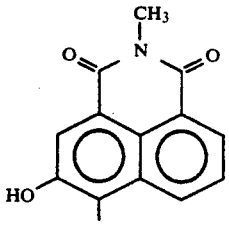
$R_1$: —$CH_3$
$Ar_1$, $Ar_2$:
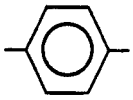
Exemplified pigment (13)
$A_1$, $A_2$:
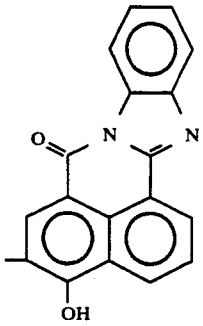
$R_1$: —$CH_3$
$Ar_1$, $Ar_2$:
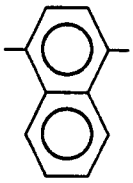
Exemplified pigment (14)
$A_1$, $A_2$:
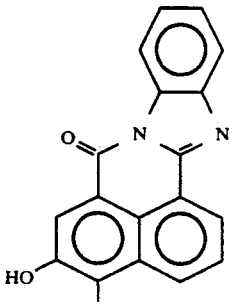
$R_1$:
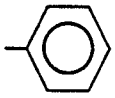
-continued
$Ar_1$, $Ar_2$:
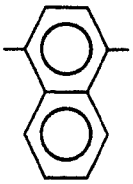
Exemplified pigment (15)
$A_1$, $A_2$:
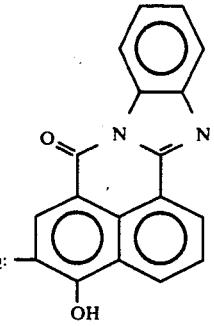
$R_1$:
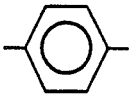
$Ar_1$, $Ar_2$:
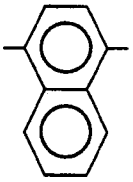
Exemplified pigment (16)
$A_1$, $A_2$:
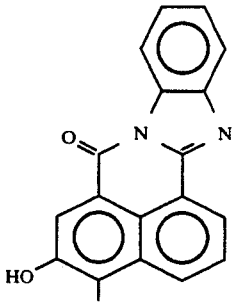
$R_1$: —H
$Ar_1$, $Ar_2$:
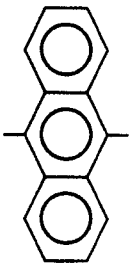
Exemplified pigment (17)

-continued
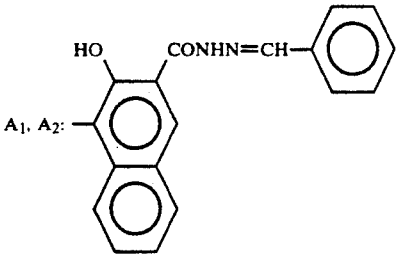
$R_1$: —H
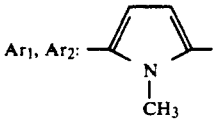
Exemplified pigment (18)
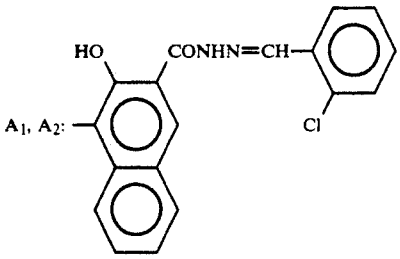
$R_1$: —H
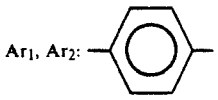
Exemplified pigment (19)
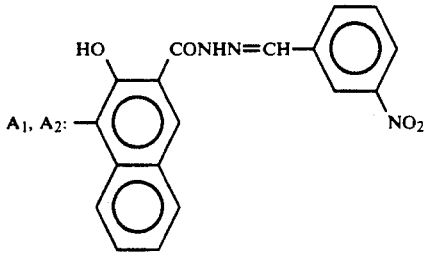
$R_1$: —H
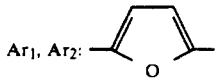
Exemplified pigment (20)
-continued
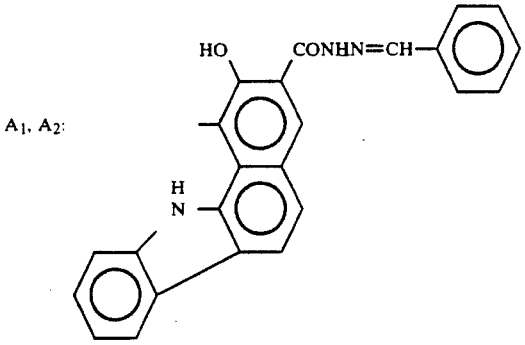
$R_1$: —H
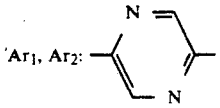
Exemplified pigment (21)
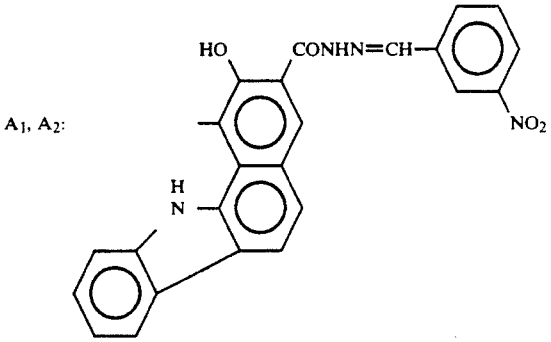
$R_1$: —H
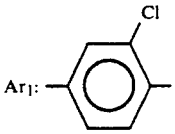
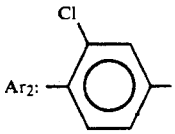
Exemplified pigment (22)
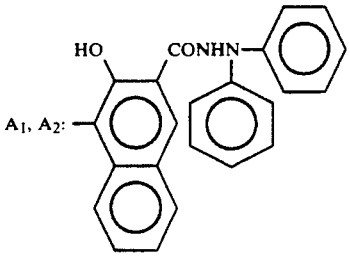
$R_1$: —H -continued
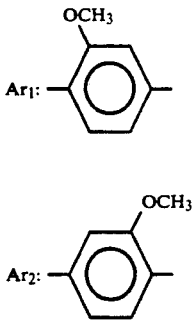
Exemplified pigment (23)
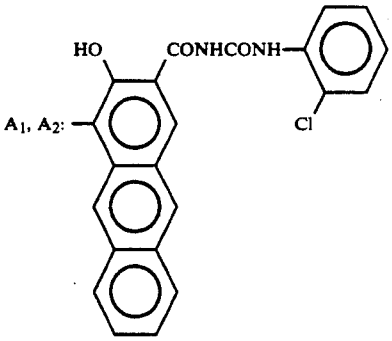
$R_1$: —H
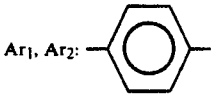
Exemplified pigment (24)
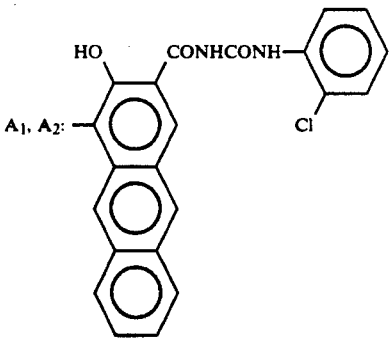
$R_1$: —Cl
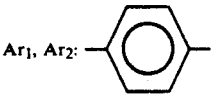
Exemplified pigment (25)
-continued
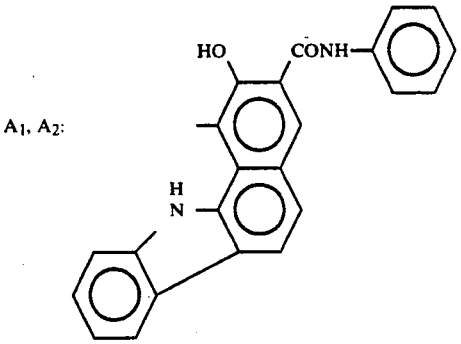
$R_1$: —H
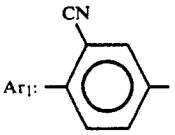
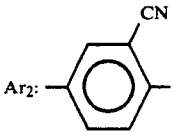
Exemplified pigment (26)
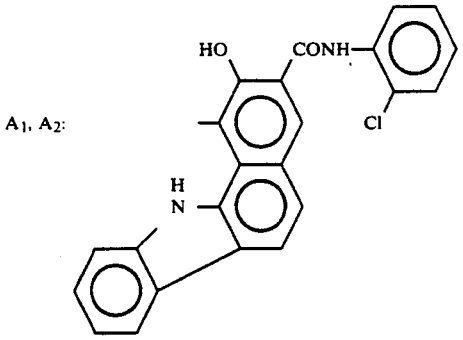
$R_1$: —H
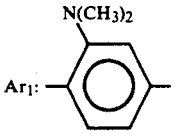
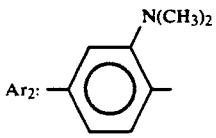
Exemplified pigment (27)

-continued
$A_1$, $A_2$:
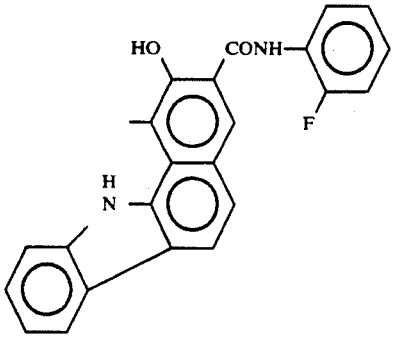
$R_1$: —Cl
$Ar_1$, $Ar_2$:
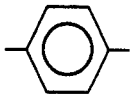
Exemplified pigment (28)
$A_1$, $A_2$:
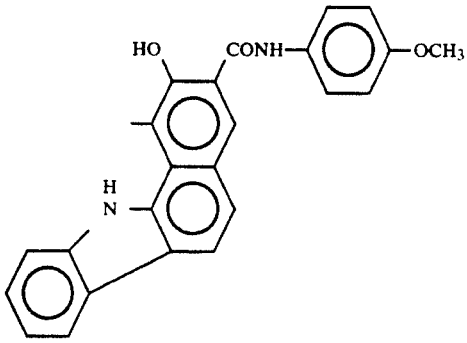
$R_1$: —Cl
$Ar_1$, $Ar_2$:
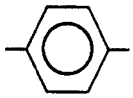
Exemplified pigment (29)
$A_1$, $A_2$:
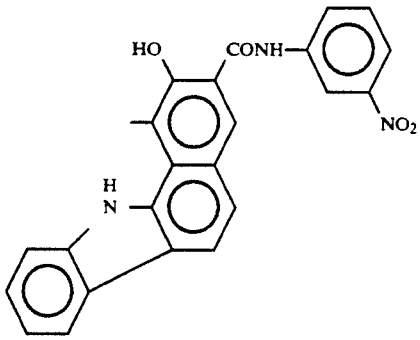
$R_1$: —Cl
$Ar_1$, $Ar_2$:
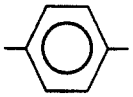
Exemplified pigment (30)
-continued
$A_1$, $A_2$:
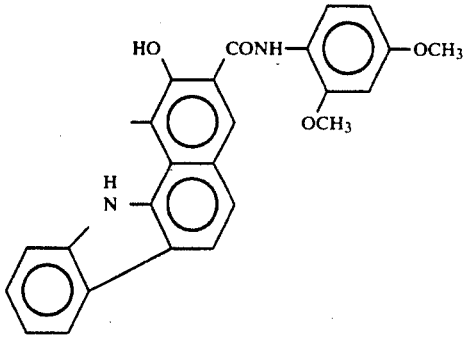
$R_1$: —Cl
$Ar_1$, $Ar_2$:
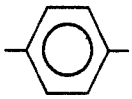
Exemplified pigment (31)
$A_1$, $A_2$:
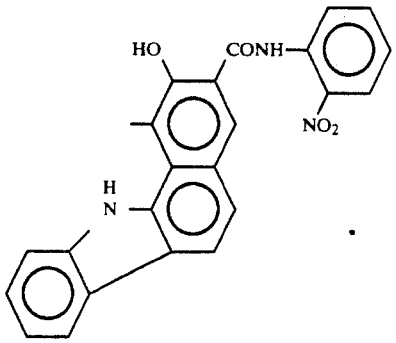
$R_1$: —Cl
$Ar_1$, $Ar_2$:
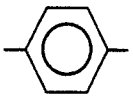
Basic Structure 2
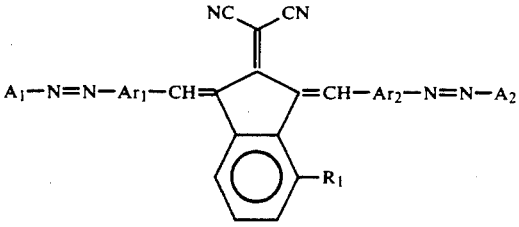
Exemplified pigment (32)
$A_1$, $A_2$:
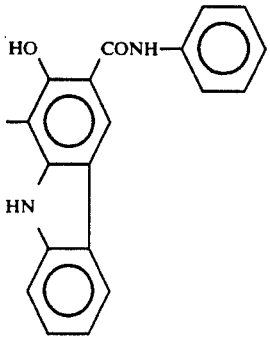

-continued
$R_1$: $-CH_3$
$Ar_1$, $Ar_2$: 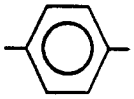
Exemplified pigment (33)
$A_1$, $A_2$: 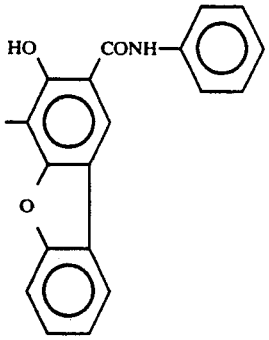
$R_1$: $-OCH_3$
$Ar_1$, $Ar_2$ 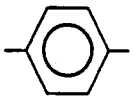
Exemplified pigment (34)
$A_1$, $A_2$: 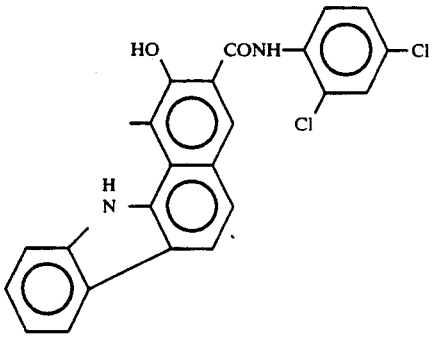
$R_1$: $-Cl$
$Ar_1$, $Ar_2$: 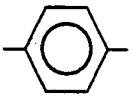
Exemplified pigment (35)
$A_1$, $A_2$: 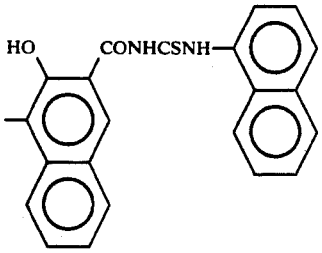
$R_1$: $-CN$
-continued
$Ar_1$, $Ar_2$: 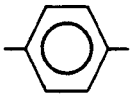
Exemplified pigment (36)
$A_1$, $A_2$: 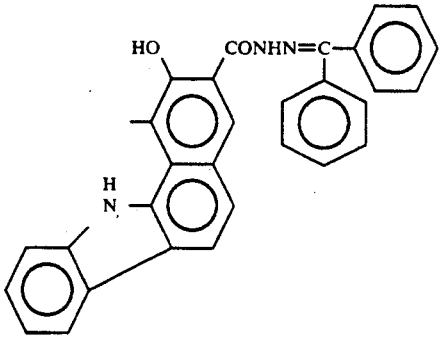
$R_1$: 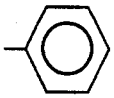
$Ar_1$, $Ar_2$: 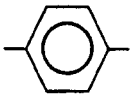
Exemplified pigment (37)
$A_1$, $A_2$: 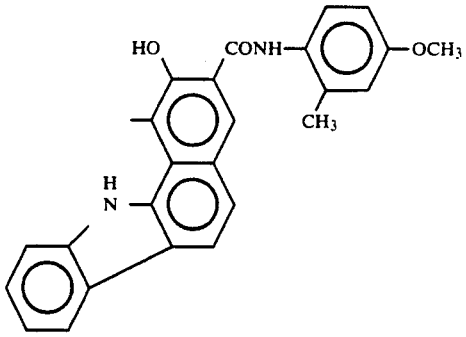
$R_1$: $-CH_2$ 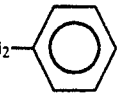
$Ar_1$, $Ar_2$: 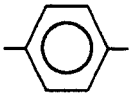
Exemplified pigment (38)

-continued
$A_1, A_2$:
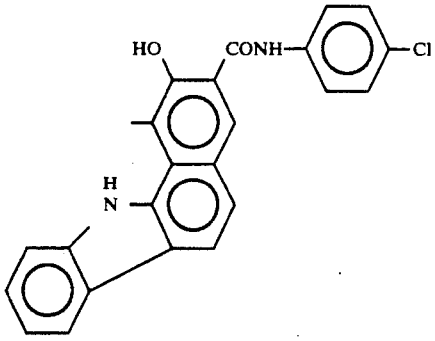
$R_1$:
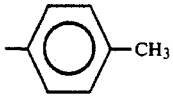
$Ar_1, Ar_2$:
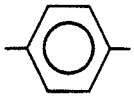
Basic Structure 3
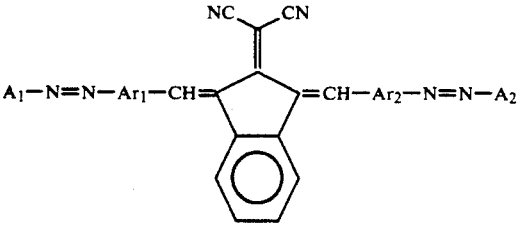
Exemplified pigment (39)
$A_1$:
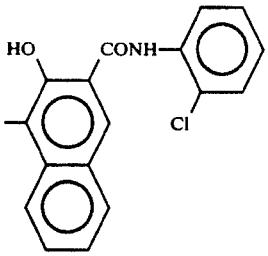
$A_2$:
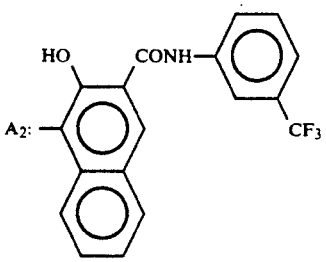
Exemplified pigment (40)
-continued
$A_1$:
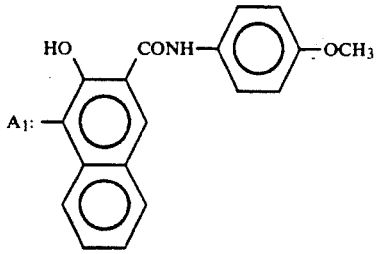
$A_2$:
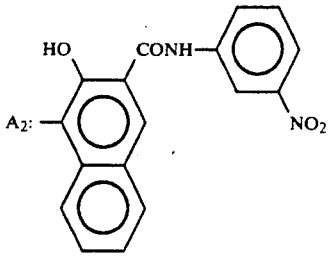
Exemplified pigment (41)
$A_1$:
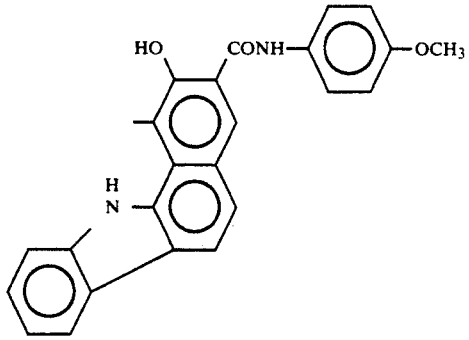
$A_2$:
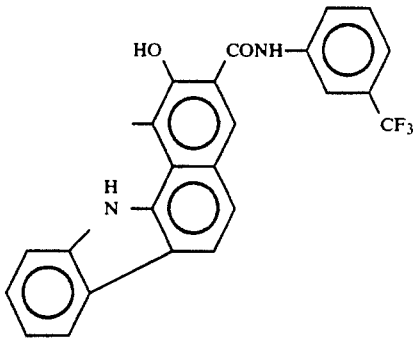
Exemplified pigment (42)
$A_1$:
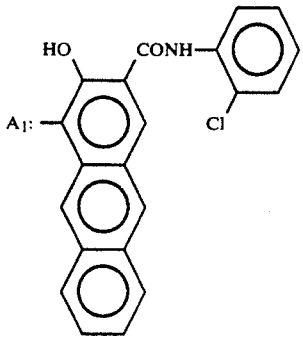

-continued
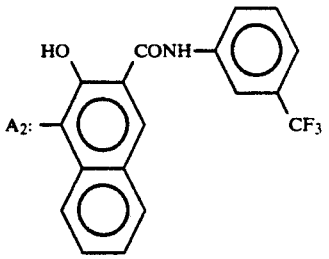
Exemplified pigment (43)
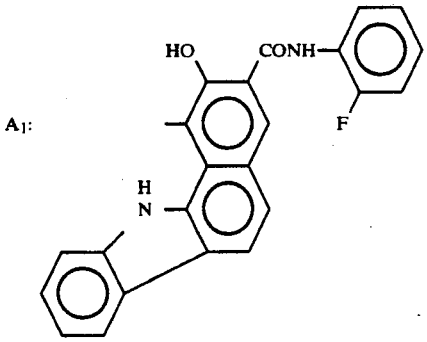
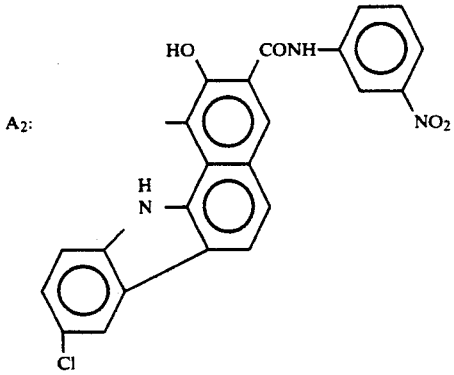
Basic Structure 4
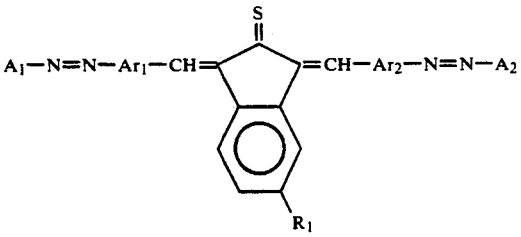
Exemplified pigment (44)
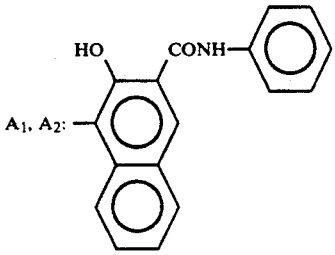
$R_1$: —H
-continued
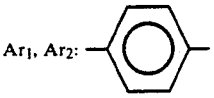
Exemplified pigment (45)
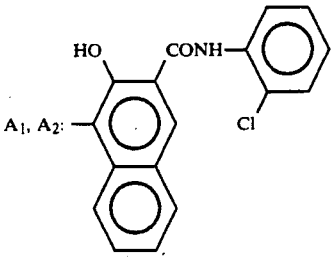
$R_1$: —H
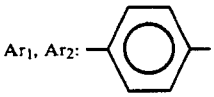
Exemplified pigment (46)
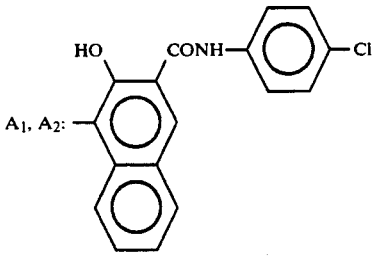
$R_1$: —$OCH_3$
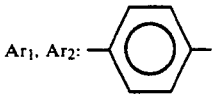
Exemplified pigment (47)
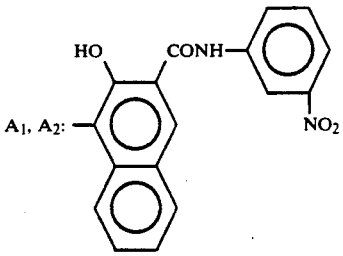
$R_1$: —$NO_2$
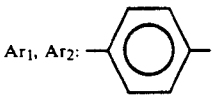
Exemplified pigment (48)

-continued
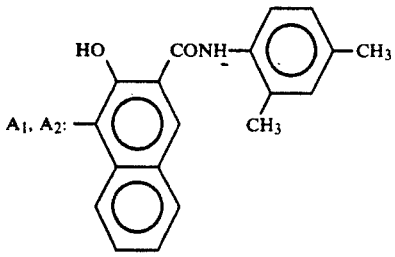
$R_1$: $-NO_2$
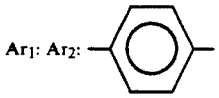
Exemplified pigment (49)
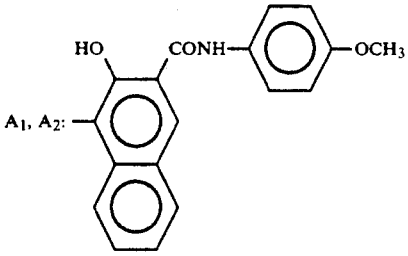
$R_1$: $-NO_2$
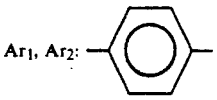
Exemplified pigment (50)
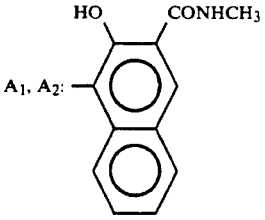
$R_1$: $-NO_2$
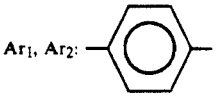
Exemplified pigment (51)
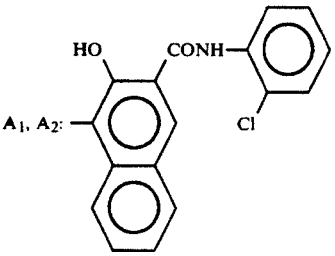
$R_1$: $-Cl$
-continued
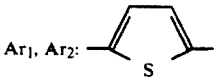
Exemplified pigment (52)
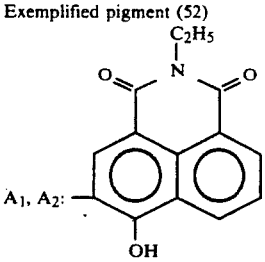
$R_1$: $-H$
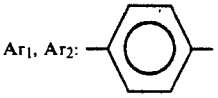
Exemplified pigment (53)
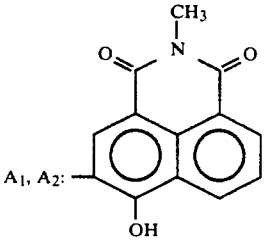
$R_1$: $-CN$
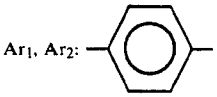
Exemplified pigment (54)
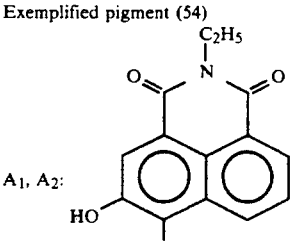
$R_1$: $-H$
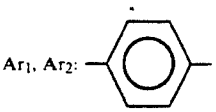
Exemplified pigment (55)
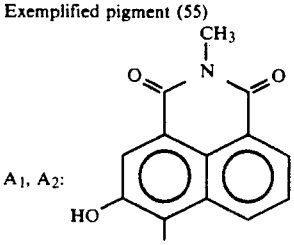
$R_1$: $-CH_3$ -continued
$Ar_1$, $Ar_2$:
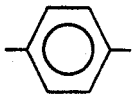
Exemplified pigment (56)
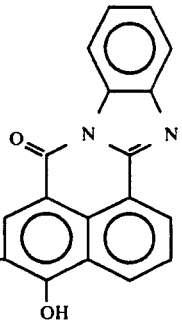
$A_1$, $A_2$:
$R_1$: $-CH_3$
$Ar_1$, $Ar_2$:
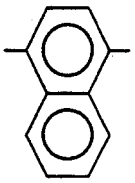
Exemplified pigment (57)
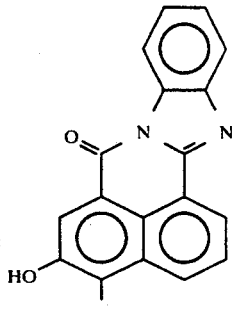
$A_1$, $A_2$:
$R_1$:
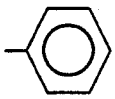
$Ar_1$, $Ar_2$:
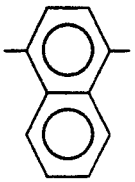
Exemplified pigment (58)
-continued
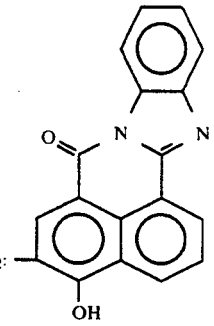
$A_1$, $A_2$:
$R_1$:
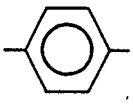
$Ar_1$, $Ar_2$:
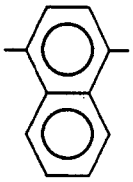
Exemplified pigment (59)
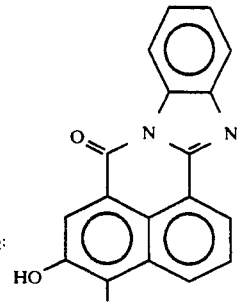
$A_1$, $A_2$:
$R_1$: $-H$
$Ar_1$, $Ar_2$:
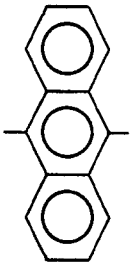
Exemplified pigment (60)
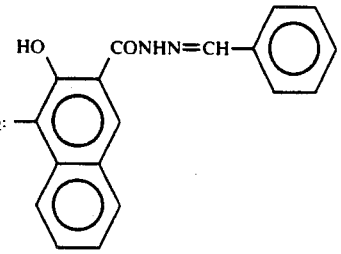
$A_1$, $A_2$:
$R_1$: $-H$ -continued
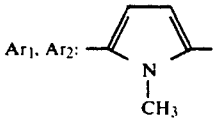
Exemplified pigment (61)
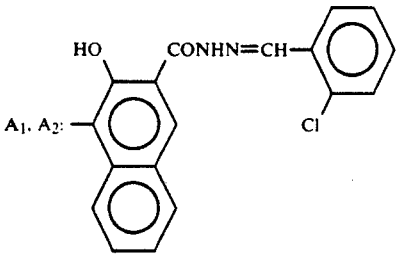
$R_1$: —H
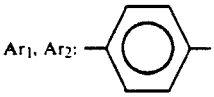
Exemplified pigment (62)
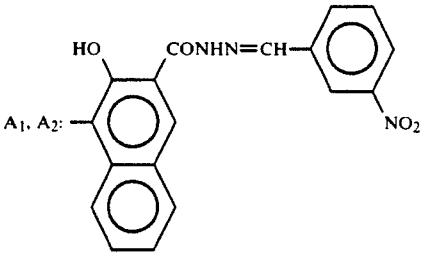
$R_1$: —H
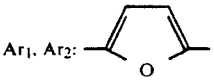
Exemplified pigment (63)
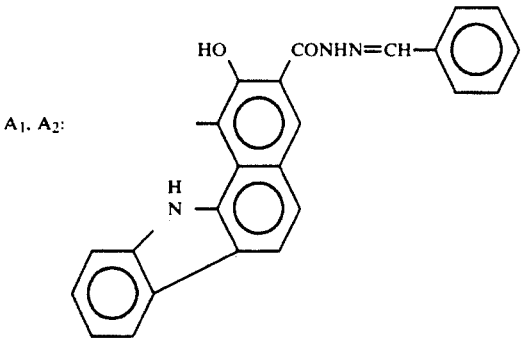
$R_1$: —H
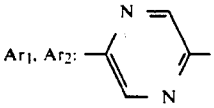
Exemplified pigment (64)
-continued
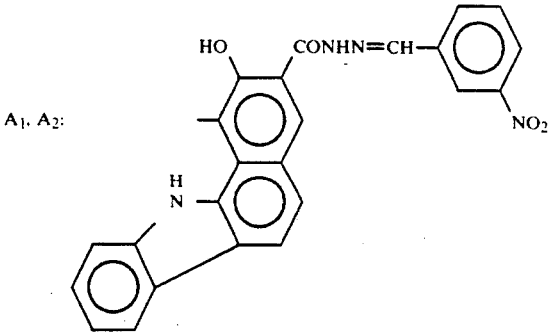
$R_1$: —H
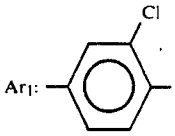
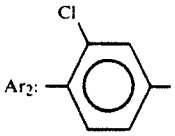
Exemplified pigment (65)
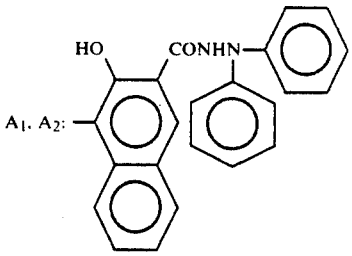
$R_1$: —H
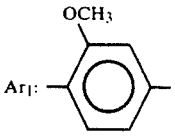
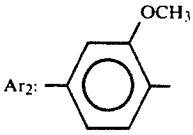
Exemplified pigment (66)
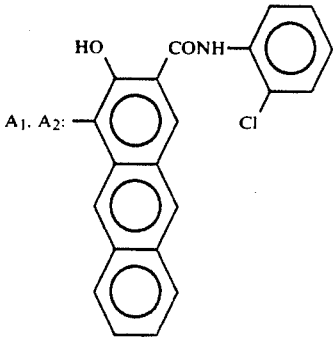

-continued
$R_1$: —H
$Ar_1$, $Ar_2$: 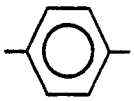
Exemplified pigment (67)
$A_1$, $A_2$: 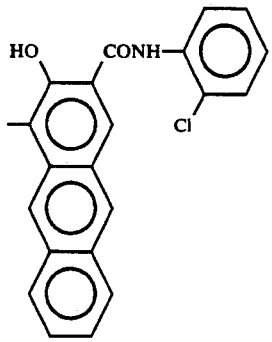
$R_1$: —Cl
$Ar_1$, $Ar_2$: 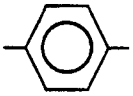
Exemplified pigment (68)
$A_1$, $A_2$: 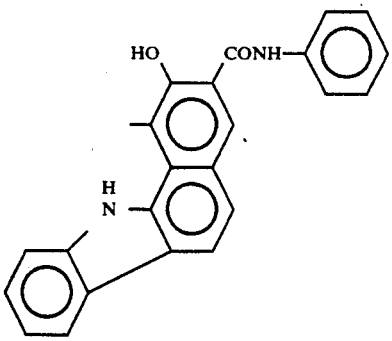
$R_1$: —H
$Ar_1$: 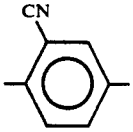
$Ar_2$: 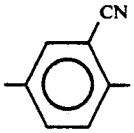
Exemplified pigment (69)
-continued
$A_1$, $A_2$: 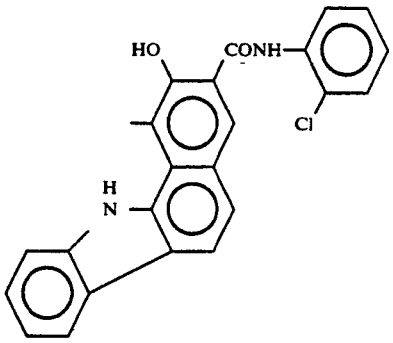
$R_1$: —H
$Ar_1$: 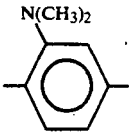
$Ar_2$: 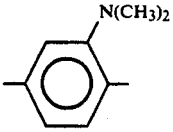
Exemplified pigment (70)
$A_1$, $A_2$: 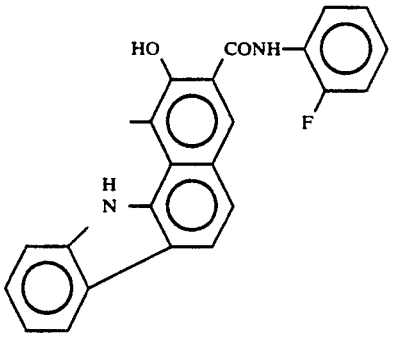
$R_1$: —Cl
$Ar_1$, $Ar_2$: 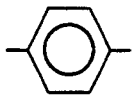
Exemplified pigment (71)
$A_1$, $A_2$: 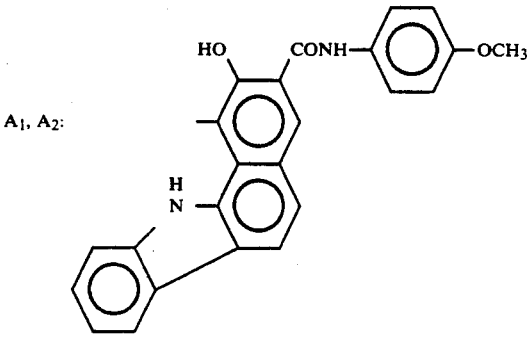
$R_1$: —Cl -continued
$Ar_1$, $Ar_2$: 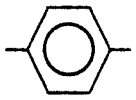
Exemplified pigment (72)
$A_1$, $A_2$: 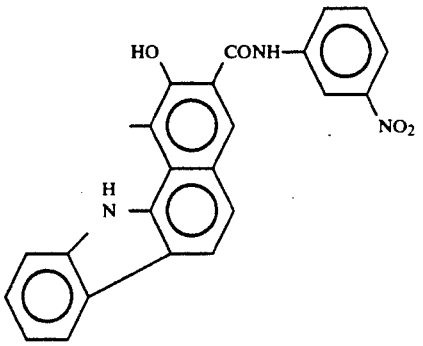
$R_1$: —Cl
$Ar_1$, $Ar_2$: 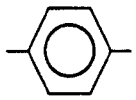
Exemplified pigment (73)
$A_1$, $A_2$: 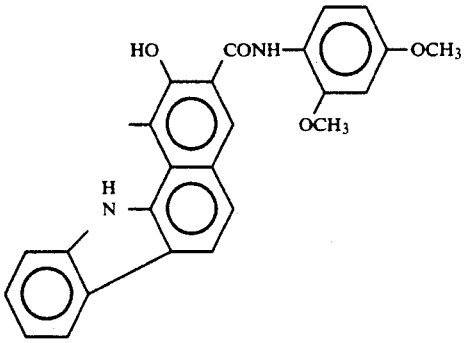
$R_1$: —Cl
$Ar_1$, $Ar_2$: 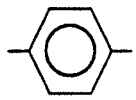
Exemplified pigment (74)
$A_1$, $A_2$: 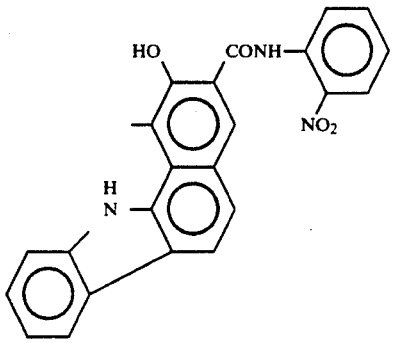
$R_1$: —Cl
-continued
$Ar_1$, $Ar_2$: 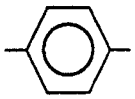
Basic Structure 5
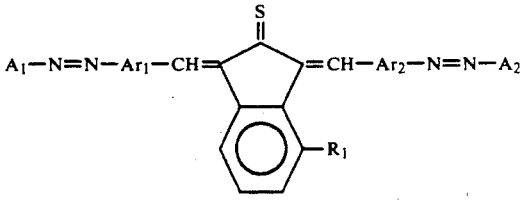
Exemplified pigment (75)
$A_1$, $A_2$: 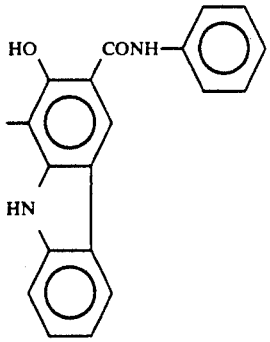
$R_1$: —$CH_3$
$Ar_1$, $Ar_2$: 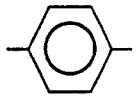
Exemplified pigment (76)
$A_1$, $A_2$: 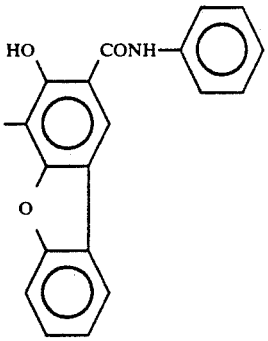
$R_1$: —$OCH_3$
$Ar_1$, $Ar_2$: 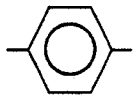
Exemplified pigment (77)

-continued
$A_1$, $A_2$:
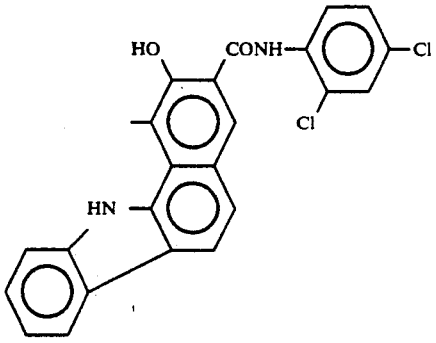
$R_1$: —Cl
$Ar_1$, $Ar_2$:
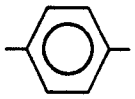
Exemplified pigment (78)
$A_1$, $A_2$:
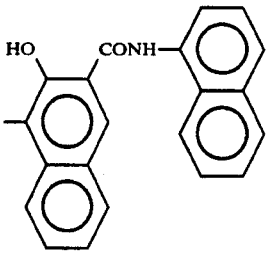
$R_1$: —CN
$Ar_1$, $Ar_2$:
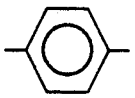
Exemplified pigment (79)
$A_1$, $A_2$:
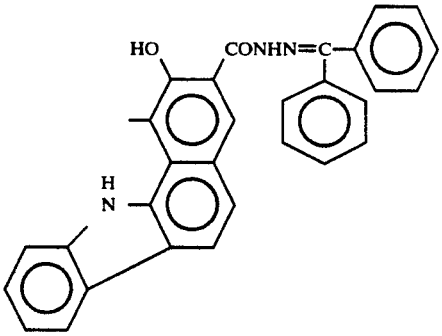
$R_1$:
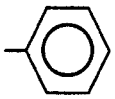
$Ar_1$, $Ar_2$:
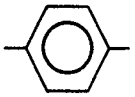
Exemplified pigment (80)
-continued
$A_1$, $A_2$:
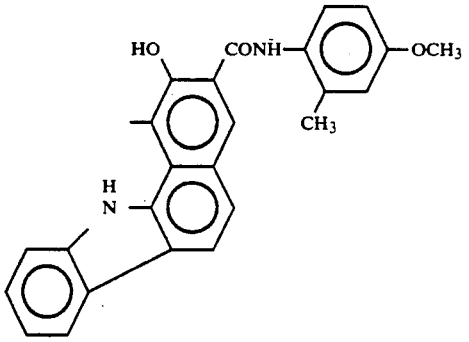
$R_1$: —$CH_2$—
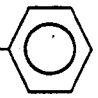
$Ar_1$, $Ar_2$:
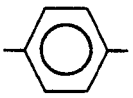
Exemplified pigment (81)
$A_1$, $A_2$:
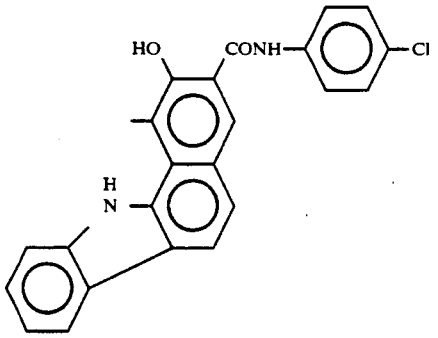
$R_1$:
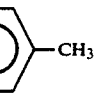
$Ar_1$, $Ar_2$:
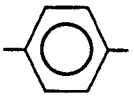
Basic Structure 6
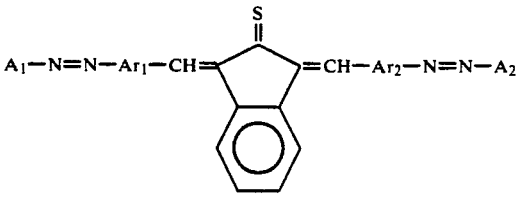
Exemplified pigment (82)

-continued
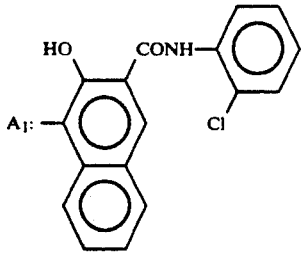
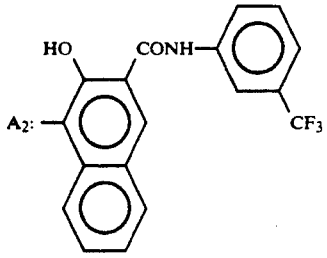
Exemplified pigment (83)
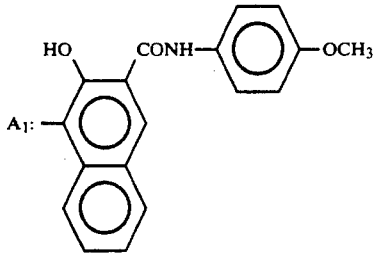
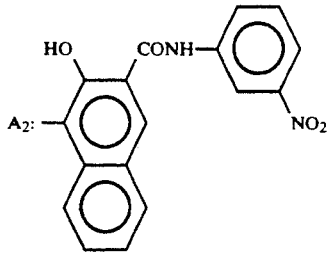
Exemplified pigment (84)
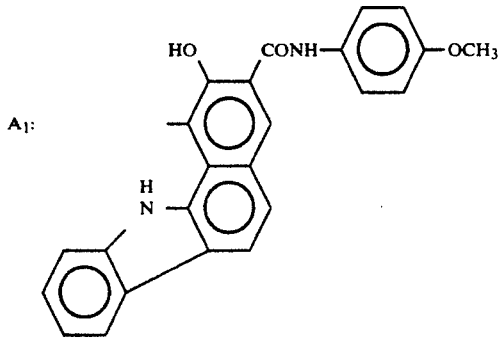
-continued
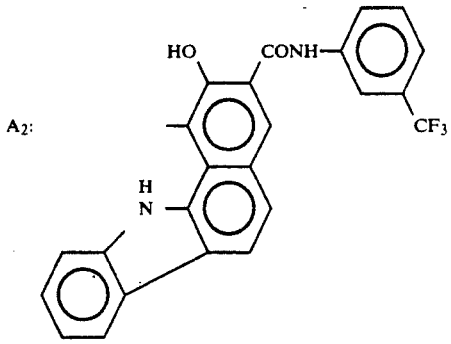
Exemplified pigment (85)
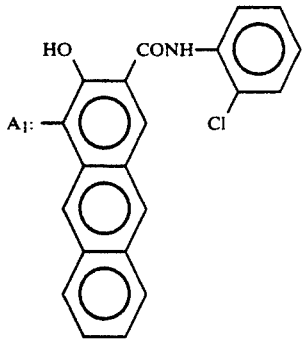
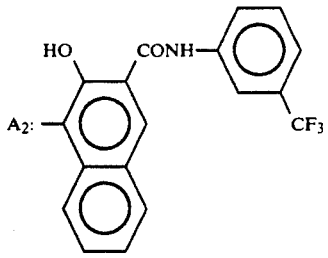
Exemplified pigment (86)
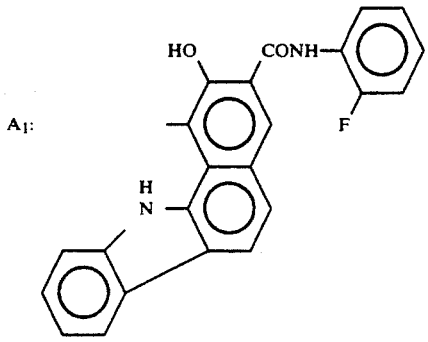

-continued $A_2$:

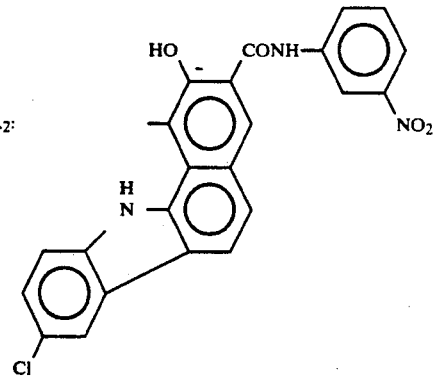

A general method for synthesis of the compound of Formula (1) is described below. However, the synthesis method is not limited thereto.

In the case where $A_1$ and $A_2$ are the same, a diamine of the formula below is used as the starting material.

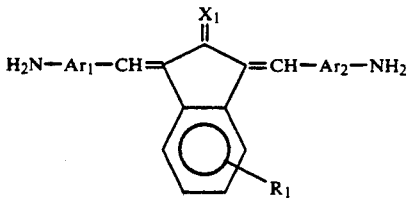

where $Ar_1$, $Ar_2$, $X_1$, $R_1$ are the same as those in Formula (1). The diamine is converted to a tetrazonium salt by use of sodium nitride or nitrosylsulfuric acid according to a conventional method. Then the resulting tetrazonium salt is (a) coupled with a coupler having the structure of $A_1$ in an aqueous solution in the presence of alkali, or (b) isolated in a form of a stable salt such as a borofluoride salt and coupled with the coupler in an organic solvent such as dimethylformamide. Thereby the compound of Formula (1) is prepared.

In the case where $A_1$ is different from $A_2$, the compound is prepared by coupling the tetrazonium salt with an equimolar amount of a first coupler to prepare a monoazo compound and then coupling it with an equimolar amount of a second coupler to give the disazo pigment, or otherwise the coupling is conducted with a mixture of the two couplers. When the pigment of a surely asymmetric structure regarding $A_1$ and $A_2$ is required, preferably one of the amino groups of the diamine is protected by an acetyl group or the like and the other amino group is diazotized and coupled with one coupler, and subsequently the protected group is hydrolyzed by hydrochloric acid or the like, and diazotized again and coupled with the other coupler to give the intended pigment.

A synthesis example of Exemplified pigment (2) is shown below.

Synthesis example 200 ml of water, 20 ml (0.23 mol) of concentrated hydrochloric acid, and 12.4 g (0.032 mol) of a diamine of the general formula below were placed in 500-ml beaker, and were cooled to 0° C.

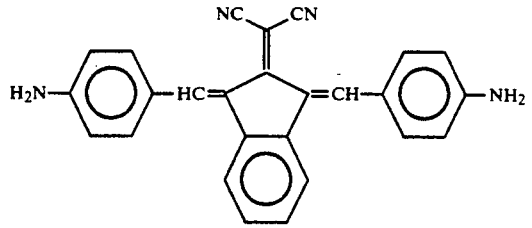

The mixture was cooled to 0° C., and thereto a solution of 4.6 g (0.067 mol) of sodium nitrite in 10 ml of water was added dropwise over 10 minutes with keeping the temperature of the liquid below 5° C. After stirring the liquid for 15 minutes, the liquid was filtered with carbon. To the filtrate, a solution of 10.5 g (0.096 mol) of sodium borofluoride in 90 ml of water was added dropwise with stirring. The deposited borofluoride salt was collected by filtration, washed with cold water and then with acetonitrile, and was dried under a reduced pressure. The yield was 11.9 g (75%).

500 ml of N,N-dimethylformamide (DMF) was placed in a 1-liter beaker. Thereto 12.5 g (0.042 mol) of the compound of the formula:

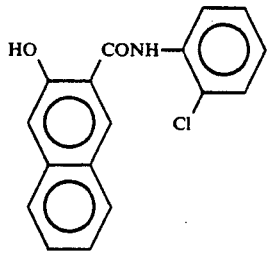

was dissolved and the liquid was cooled to a temperature of 5° C. Thereto, 9.88 g (0.020 mol) of the borofluoride salt prepared above was dissolved, and 5.1 g (0.050 mol) of triethylamine was further added dropwise over 5 minutes. The liquid was stirred for 2 hours, and the deposited pigment was collected by filtration, washed four times with DMF, three times with water, and freeze-dried. The yield was 16.0 g (80.0%). The result of elemental analysis was as below.

| | Calculated (%) | Found (%) |
|---|---|---|
| C | 71.78 | 71.99 |
| H | 3.61 | 3.71 |
| N | 11.16 | 11.08 |
| Cl | 7.06 | 6.95 |

In the present invention, the photosensitive layer, which contains the compound represented by the general formula (1), includes those of the structures below. The structures are shown with the layer order of (lower layer)/(upper layer).

(1) A layer containing a charge-generating substance (charge-generating layer)/a layer containing a charge-transporting substance (charge-transporting layer), (2) A charge-transporting layer/a charge-generating layer (3) A layer containing a charge-generating substance and a charge-transporting substance.

Naturally, the structure of the photosensitive layer of the present invention is not limited to those mentioned above. The structures are described below in detail.

The charge-generating layer may be formed by applying onto an electroconductive support a coating liquid which has been prepared by dispersing the azo pigment of Formula (1) and a binder in a suitable solvent. The film thickness is preferably not more than 5 μm, more preferably in the range of from 0.1 to 1 μm.

The binder resin used may be selected from a variety of insulating resins and organic photoconductive polymers. Preferred resins are polyvinylbutyrals, polyvinylbenzals, polyarylates, polycarbonates, polyesters, phenoxy resins, cellulose resins, acrylic resins, polyurethanes, and the like. The content of the binder resin in the charge-generating layer is preferably not more than 80% by weight, more preferably not more than 40% by weight.

Any solvent may be employed, provided that the solvent dissolves the above-mentioned resin. Specific examples of the solvents include ethers such as tetrahydrofuran, and 1,4-dioxane; ketones such as cyclohexanone and methyl ethyl ketone; amides such as N,N-dimethylformamide; esters such as methyl acetate, and ethyl acetate; aromatic solvents such as toluene, xylene, and chlorobenzene; alcohols such as methanol, ethanol, and 2-propanol; aliphatic halogenated hydrocarbons such as chloroform, methylene chloride, dichloroethylene, carbon tetrachloride, and trichloroethylene; and the like. Among them, preferable are solvents which does not dissolve the charge-transporting layer nor the subbing layer described later.

The azo pigment employed in the present invention may be either amorphous or crystalline. The azo pigments of Formula (1) may be used in a combination thereof or a combination with a known charge-generating substance optionally.

The charge-transporting layer may be formed inside or outside the charge-generating layer, and has a function of receiving charge carriers from the charge-generating layer and transporting the carriers under an electric field.

The charge-transporting layer may be formed by applying a solution of a charge-transporting substance and optionally a suitable binder resin in a solvent. The film thickness is preferably in the range of from 5 to 40 μm, more preferably from 15 to 30 μm.

The charge-transporting substance includes electron-transporting substances and positive-hole-transporting substances. The examples of the electron-transporting substances are electron-attracting substances such as 2,4,7-trinitrofluorenone, 2,4,5,7-tetranitrofluoroenone, chloranil, and tetracyanoquinodimethane; and polymers of such electron-attracting substances.

The positive-hole-transporting substances include polycyclic aromatic compounds such as pyrene and anthracene; heterocyclic compounds including carbazoles, indoles, imidazoles, oxazoles, thiazoles, oxadiazoles, pyrazoles, pyrazolines, thiadiazoles, and triazoles; hydrazone compounds such as p-diethylaminobenzaldehyde-N,N, and N,N-diphenylhydrazino-3-methylidene-9-ethylcarbazole; styryl compounds such as α-phenyl-4'-N,N-diphenylaminostilbene, and 5-[4-(di-p-tolylamino)benzylidene]-5H-dibenzo[a,d]cycloheptene; benzidines; triarylmethanes, triphenylamines; and the like; and polymers having a radical derived from the above compound in the main chain or the side chain thereof such as poly-N-vinylcarbazole, polyvinylanthracene, etc.

In addition to these organic charge-transporting substances, inorganic materials such as selenium, selenium-tellurium, amorphous silicon, and cadmium sulfide may be used.

Two or more of these charge-transporting substances may be used in combination.

If the charge-transporting substance does not have a film-forming property, a suitable binder may be used. The specific examples of the binder include insulating resins such as acrylic resins, polyarylates, polyesters, polycarbonates, polystyrenes, acrylonitrile-styrene copolymers, polyacrylamides, polyamides, chlorinated rubbers, and the like; and organic photoconductive polymers such as poly-N-vinylcarbazole, polyvinylanthracene, and the like.

Another specific example of the present invention is an electrophotographic photosensitive member having a monolayer type photosensitive layer which contains the azo pigment of Formula (1) and a charge-transporting substance in the same layer. In this example, as the charge-transporting substance, a charge-transfer complex such as a combination of poly-N-vinylcarbazole and trinitrofluorenone may also be used, which is not mentioned above.

The thickness of the photosensitive layer is preferably in the range of from 5 to 40 μm, more preferably from 10 to 30 μm.

As a protecting layer, a simple resin layer or a resin layer containing electroconductive particles or charge-transporting substance may be provided for the purpose of protecting the photosensitive layer from adverse mechanical and chemical influences in the present invention.

Every layer mentioned above may be formed by means of a coating method, such as dip coating, spray coating, beam coating, roller coating, Mayer bar coating and blade coating, using appropriate organic solvents.

The electroconductive support may be made of such a material like aluminum, aluminum alloy, copper, zinc, stainless steel, vanadium, molybdenum, chromium, titanium, nickel, indium, gold, and platinum. Further, the electroconductive support may be a plastic on which a film of the metal or metal alloy as mentioned above is formed by vacuum vapor deposition (the plastic including polyethylene, polypropylene, polyvinyl chloride, polyethylene terephthalate, acrylic resins, and the like); or may be a plastic or metal substrate which is coated with a mixture of electroconductive particles (such as carbon black particles, and silver particles) and a suitable binder; or otherwise may be a plastic or paper sheet impregnated with electroconductive particles.

A subbing layer having a barrier function and an adhesive function may be provided between the electroconductive support and the photosensitive layer. The subbing layer may be made of casein, polyvinyl alcohol, nitrocellulose, polyamides such as nylon 6, nylon 66, nylon 610, nylon copolymers, and alkoxymethylated nylon, polyurethanes, aluminum oxide, and the like. The thickness of the subbing layer is preferably not more than 5 μm, more particularly in the range of from 0.1 to 3 μm.

The electroconductive support may be in a shape of a drum, a sheet, a belt, or the like.

The electrophotographic photosensitive member of the present invention in not only useful for electrophotographic copying machines but also useful for a variety of electrophotography application fields including facsimiles, laser beam printers, CRT printers, LED printers, liquid crystal printers, laser engraving systems, and so forth.

FIG. 1 shows a schematic diagram of a usual transfer type electrophotographic apparatus employing the electrophotographic photosensitive member of the present invention.

In FIG. 1, a drum type photosensitive member 1 serves as an image carrier, being driven to rotate around the axis 1*a* in the arrow direction at a predetermined peripheral speed. The photosensitive member 1 is charged positively or negatively at the peripheral face uniformly during the rotation by an electrostatic charging means 2, and then exposed to image-exposure light L (e.g. slit exposure, laser beam-scanning exposure, etc.) at the exposure portion 3 with an image-exposure means (not shown in the figure), whereby electrostatic latent images are sequentially formed on the peripheral surface in accordance with the exposed image.

The elctrostatic latent image is developed with a toner by a developing means 4, and the toner-developed images are sequentially transferred by a transfer means 5 onto a transfer-receiving material P which is fed between the photosensitive member 1 and the transfer means 5 synchronously with the rotation of the photosensitive member 1 from a transfer-receiving material feeder not shown in the figure.

The transfer-receiving material P having received the transferred image is separated from the photosensitive member surface, and introduced to an image fixing means 8 for fixation of the image and discharged from the copying machine as a duplicate copy.

The surface of the photosensitive member 1, after the image transfer, is cleaned with a cleaning means 6 to remove any residual un-transferred toner, and is treated for electrostatic charge erasing means 7 for repeated use for image formation.

The generally and usually employed charging means 2 for uniformly charging the photosensitive member 1 are corona charging apparatuses. The generally and usually employed transfer means 5 are also a corona charging means. In the electrophotographic apparatus, two or more of the constitutional elements of the above described photosensitive member, the developing means, the cleaning means, etc. may be integrated as one apparatus unit, which may be made demountable from the main body of the apparatus. For example, at least on of an electrostatic charging means, a developing means, and a cleaning means is combined with the photosensitive member into one unit demountable from the main body of the apparatus by aid of a guiding means such as a rail of the main body of the apparatus. A charging means and/or a developing means may be combined with the aforementioned unit.

In the case where the electrophotographic apparatus is used as a copying machine or a printer, the optical image exposure light L is projected onto the photosensitive member as reflected light or transmitted light from an original copy, or otherwise projected onto a photosensitive member by signalizing information read out with a sensor from an original copy and then scanning with a laser beam, driving an LED array, or driving a liquid crystal shutter array according to the signal.

Figure 2:
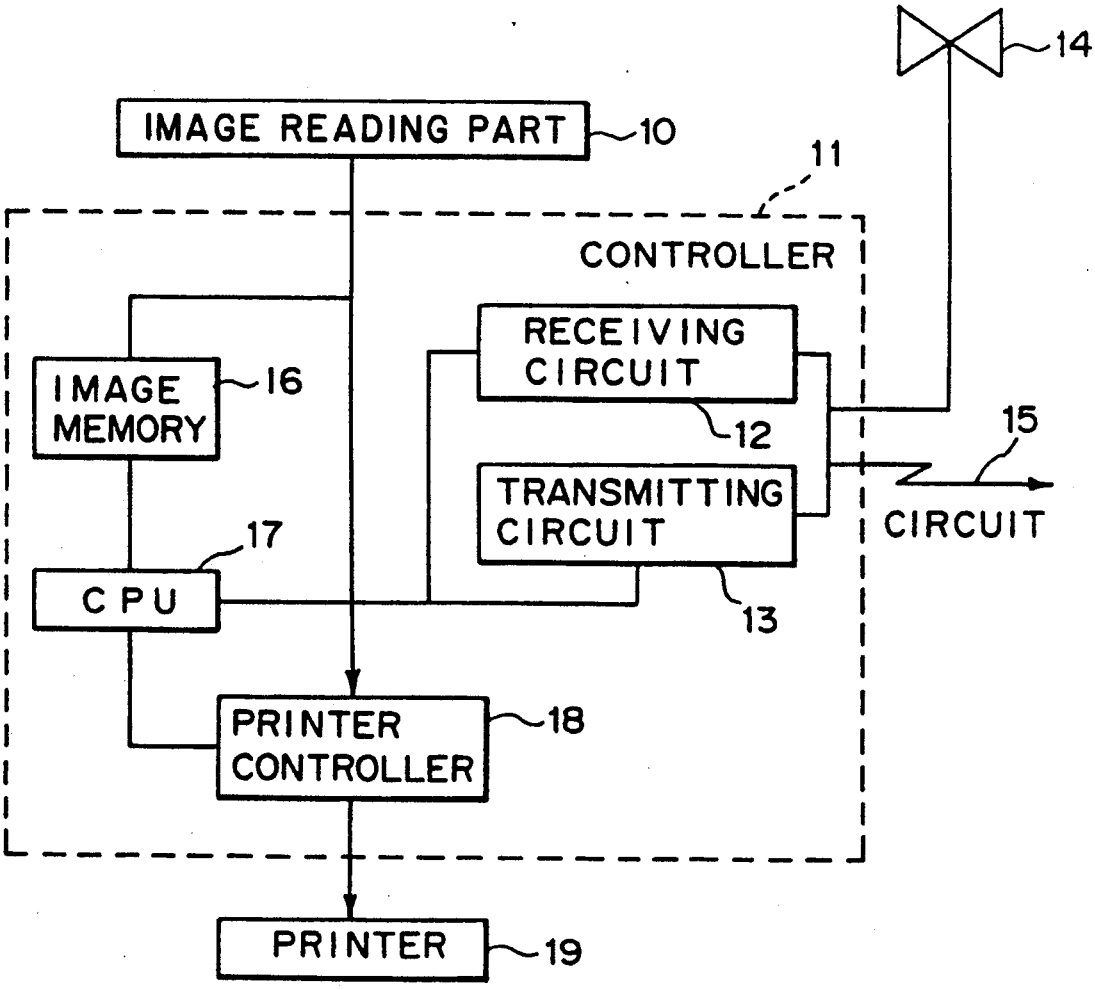
FIG. 2 illustrates an example of a block diagram of a facsimile employing the electrophotographic photosensitive member of the present invention.

In the case where the electrophotographic apparatus is used as a printer of a facsimile apparatus, the optical image exposure light L is for printing the received data. FIG. 2 is a block diagram of an example of this case.

A controller 11 controls an image reading part 10 and a printer 19. The whole of the controller 11 is controlled by a CPU 17. Readout data from the image reading part is transmitted through a transmitting circuit 13 to the other communication station. Data received from the other communication station is transmitted through a receiving circuit 12 to a printer 19. The image data is stored in image memory. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of images are stored in the image memory 16, the images are recorded in such a manner that the CPU 17 reads out the one page of image information, and sends out the decoded one page of information to the printer controller 18, which controls the printer 19 on receiving the one page of information from CPU 17 to record the image information.

Incidentally the CPU 17 receives the following page of information while recording is conducted by the printer 19.

Images are received and recorded in the manner as described above.

EXAMPLE 1

Onto an aluminum substrate, a solution of 5 g of methoxymethylated nylon (weight-average molecular weight: 32,000) and 10 g of alcohol-soluble copolymer nylon (weight-average molecular weight: 29,000) in 95 g of methanol was applied with a Mayer bar to form a subbing layer of 1 μm in dry thickness.

Separately, 5 g of the Exemplified pigment (1) was added to a solution of 2 g of a butyral resin (butyralation degree: 63 mol %) in 95 g of cyclohexanone, and was dispersed for 20 hours by means of a sand mill. The resulting dispersion was applied and dried on the subbing layer formed as above with a Meyer bar to give a charge-generating layer of 0.2 μm in dry thickness.

5 g of the styryl compound represented by the structural formula below:

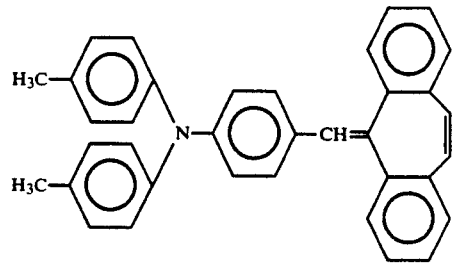

and 5 g of bisphenol A type polycarbonate (number-average molecular weight: 100,000) were dissolved in 35 g of chlorobenzene. The solution was applied onto the above-mentioned charge-generating layer with a Mayer bar and dried to form a charge-transporting layer of 20 μm in dry thickness.

The electrophotographic photosensitive member prepared thus was tested for charging characteristics by means of an electrostatic copying-paper tester (Model SP-428, made by Kawaguchi Denki K. K.) by subjecting the member to corona charge at −5 KV to be negatively charged, leaving it in the dark for 1 second, and exposing it to light of illuminance of 10 lux.

The charging characteristics measured were the surface potential ($V_0$) immediately after the charging, and the quantity of light exposure ($E_{\frac{1}{2}}$) required for decay of the surface potential by half after 1 second of dark standing, namely sensitivity.

The results are shown in Table 1.

EXAMPLES 2-20

Electrophotographic photosensitive members were prepared and evaluated in the same manner as in Example 1 except that each of Exemplified pigments shown in Table 1 was used in place of Exemplified pigment (1).

The results are shown in Table 1.

TABLE 1

| Example | Exemplified pigment | $V_0$ (−V) | $E_{\frac{1}{2}}$ (lux · sec) |
|---|---|---|---|
| 1 | (1) | 700 | 1.00 |
| 2 | (3) | 699 | 1.02 |
| 3 | (4) | 698 | 1.01 |
| 4 | (8) | 701 | 1.03 |
| 5 | (12) | 699 | 0.99 |

TABLE 1-continued

| Example | Exemplified pigment | $V_0$ (−V) | $E_{\frac{1}{2}}$ (lux · sec) |
|---|---|---|---|
| 6 | (14) | 701 | 0.98 |
| 7 | (23) | 700 | 1.02 |
| 8 | (28) | 698 | 1.01 |
| 9 | (41) | 697 | 1.11 |
| 10 | (43) | 698 | 1.12 |
| 11 | (44) | 698 | 1.23 |
| 12 | (46) | 699 | 1.20 |
| 13 | (48) | 700 | 1.10 |
| 14 | (58) | 701 | 0.99 |
| 15 | (64) | 699 | 1.01 |
| 16 | (67) | 698 | 1.10 |
| 17 | (70) | 699 | 1.13 |
| 18 | (72) | 700 | 1.24 |
| 19 | (82) | 700 | 1.13 |
| 20 | (85) | 701 | 1.14 |

Comparative examples 1-6

Electrophotographic photosensitive members were prepared and evaluated for charging characteristics in the same manner as in Example 1 except that Comparative pigments (A) to (F) represented by the structural formulas below were used respectively in place of the azo pigment employed in Example 1.

The results are shown in Table 2.

Comparative pigment (A)

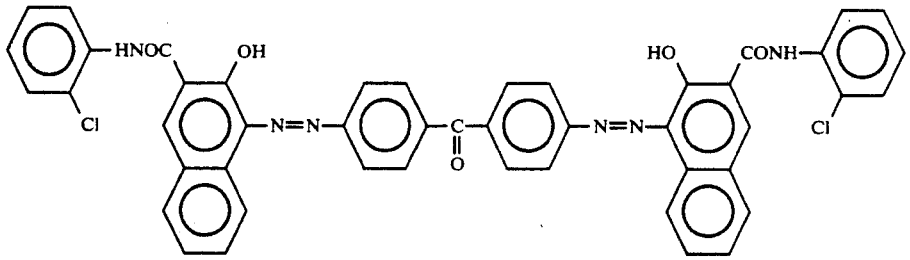

Comparative pigment (B)

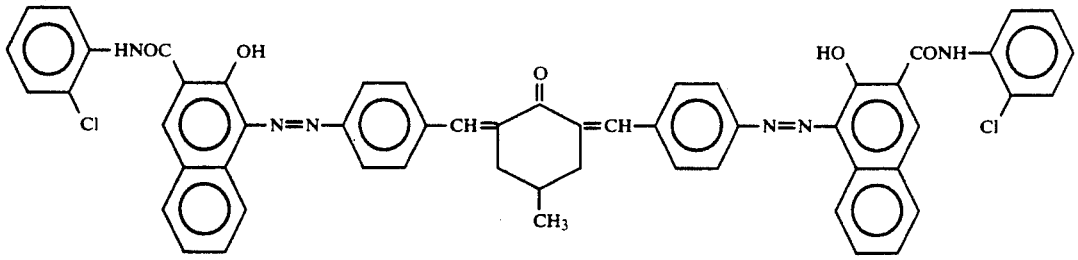

Comparative example (C)

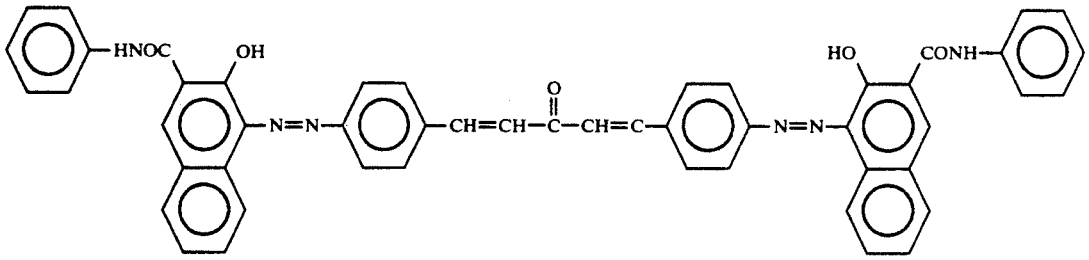

Comparative pigment (D)

-continued

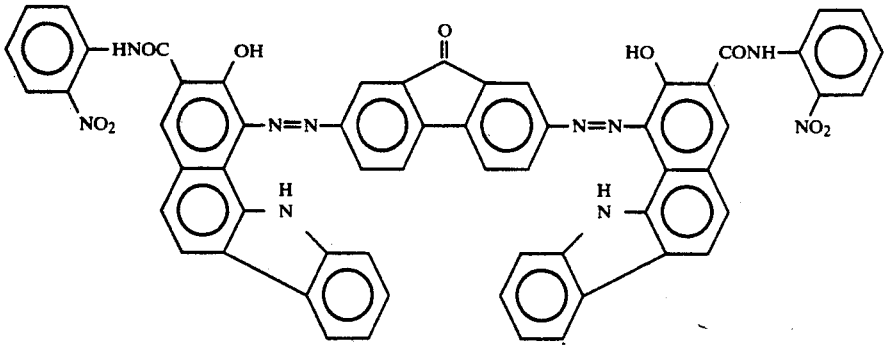

Comparative pigment (E)

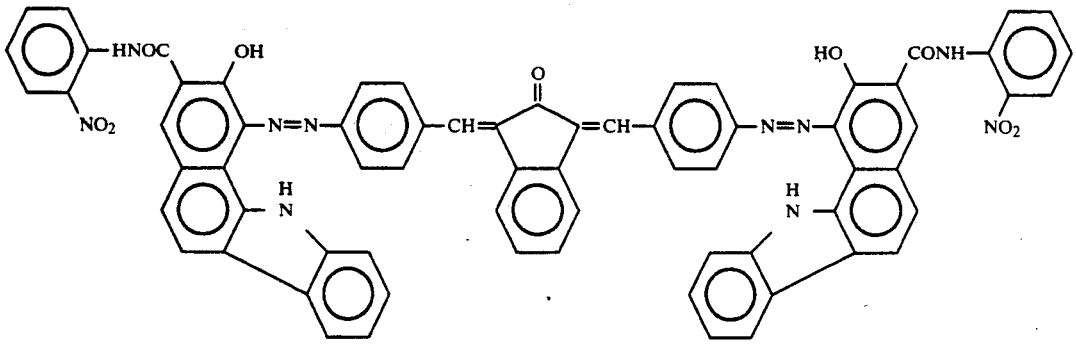

Comparative example (F)

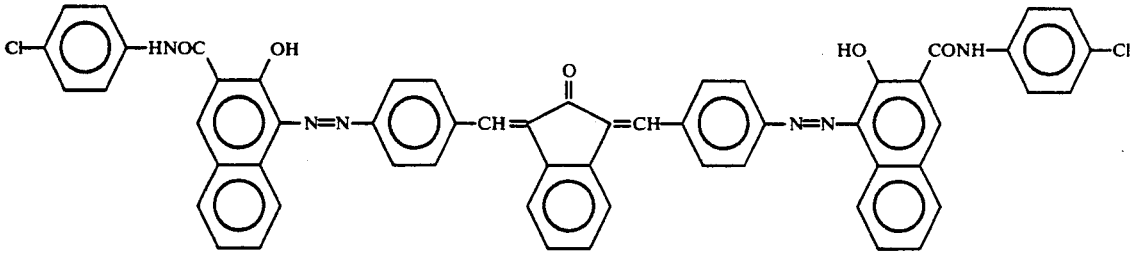

TABLE 2

| Comparative example | Exemplified pigment | $V_0$ (−V) | $E_{\frac{1}{2}}$ (lux · sec) |
|---|---|---|---|
| 1 | (A) | 660 | 8.8 |
| 2 | (B) | 670 | 4.6 |
| 3 | (C) | 680 | 6.0 |
| 4 | (D) | 689 | 4.9 |
| 5 | (E) | 678 | 3.6 |
| 6 | (F) | 689 | 5.5 |

EXAMPLE 21

The electrophotographic photosensitive member prepared in Example 1 was sticked onto a cylinder of an electrophotographic copying machine equipped with a −6.5 KV corona charger, a charge-erasing light-exposing system, a developer, a transfer-charger, a destaticizing light-exposing system, and a cleaner.

With this copying machine, the dark portion potentials ($V_D$) and light portion potential ($V_L$) at the initial stage were set at approximately −700 V and −200 V respectively, and the changes of the dark-portion potentials ($\Delta V_D$) and of the light-portion potentials ($\Delta V_L$) after 7000 times copying were measured to evaluate the durability characteristics.

The results are shown in Table 3, where a negative value of the change means decrease of the absolute value of the potential and a positive value of the change means increase thereof.

EXAMPLES 22-40

The electrophotographic photosensitive members prepared in Examples 2-20 were evaluated for durability characteristics in the same manner as Example 21. The results are shown in Table 3.

TABLE 3

| Example | $\Delta V_D$ (V) | $\Delta V_L$ (V) |
|---|---|---|
| 21 | −6 | +5 |
| 22 | +1 | +4 |
| 23 | −5 | +3 |
| 24 | −11 | +5 |
| 25 | −10 | +3 |
| 26 | +2 | +4 |
| 27 | −3 | +2 |
| 28 | −4 | +4 |
| 29 | +2 | +3 |
| 30 | −5 | +3 |
| 31 | −4 | +4 |
| 32 | −3 | +2 |
| 33 | −2 | +3 |
| 34 | −1 | +3 |
| 35 | +1 | +4 |

TABLE 3-continued

| Example | $\Delta V_D$ (V) | $\Delta V_L$ (V) |
|---|---|---|
| 36 | ±0 | +6 |
| 37 | −3 | +5 |
| 38 | −4 | +5 |
| 39 | −1 | +4 |
| 40 | +1 | +3 |

COMPARATIVE EXAMPLES 7-12

The electrophotographic photosensitive members prepared in Comparative examples 1-6 were evaluated for durability characteristics in the same manner as in Example 21. The results are shown in Table 4.

TABLE 4

| Comparative example | $\Delta V_D$ (V) | $\Delta V_L$ (V) |
|---|---|---|
| 7 | —* | —* |
| 8 | −70 | +100 |
| 9 | −100 | +95 |
| 10 | −80 | +90 |
| 11 | −40 | +30 |
| 12 | −30 | +29 |

*The initial potential could not be set because of the low sensitivity and the large residual potential.

EXAMPLE 41

Onto an aluminum face of an aluminum-vapor-deposited polyethylene terephthalate film, a 1.0 μm thick subbing layer of polyvinyl alcohol was formed. Thereon, the dispersion of the disazo pigment employed in Example 1 was applied with a Mayer bar, and the applied layer was dried to give a 0.2 μm thick charge-generating layer.

Subsequently, a solution of 5 g of the fluorene compound of the structural formula below:

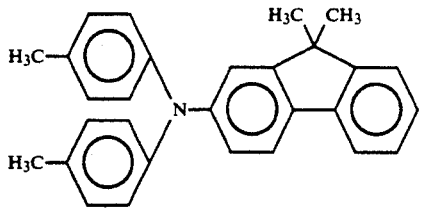

and 6 g of polycarbonate (weight-average molecular weight: 55,000) in 35 g of tetrahydrofuran was applied on the charge-generating layer, and was dried to form a charge-transporting layer of 21 μm thick. The electrophotographic photosensitive member prepared thus was tested for the charging properties and durability characteristics in the same manners as in Example 21. The results are as follows.

$V_{\alpha}$: −701 V $E_{\frac{1}{2}}$: 0.9 lux.sec $\Delta V_D$: −2 V $\Delta V_L$: +5 V

EXAMPLE 42

An electrophotographic photosensitive member was prepared in the same manner as in Example 4, except that the charge-generating layer and the charge-transporting layer were applied in the reversed order. The resulting electrophotographic photosensitive member was evaluated for charging characteristics in the same manner as in Example 1 but employing a positive charge potential:

$V_{\alpha}$: +690V $E_{\frac{1}{2}}$: 1.23 lux.sec

EXAMPLE 43

On the charge-generating layer prepared in Example 11, a solution of 5 g of 2,4,7-trinitro-9-fluorene and 5 g of poly-4,4'-dioxydiphenyl-2,2-propane carbonate (number-average molecular weight 300,000) in 50 g of chlorobenzene was applied and dried to give a 18 μm thick charge-transporting layer.

The charging characteristics of the resulting electrophotographic photosensitive member was evaluated in the same manner as in Example 1 but employing a positive charge potential.

$V_{\alpha}$: +695V $E_{\frac{1}{2}}$: 2.1 lux.sec

EXAMPLE 44

0.6 g of Exemplified pigment (46) was dispersed in 9.5 g of cyclohexanone by means of a paint shaker for 5 hours. Thereto, a solution of 4 g of the charge-transporting substance used in Example 1 and 5 g of the polycarbonate in 40 g of tetrahydrofuran was added, and the mixture was shaken further for one hour. The coating solution prepared thus was applied onto an aluminum support with a Mayer bar and was dried to form a 21 μm thick photosensitive layer.

The electrophotographic photosensitive member prepared thus was evaluated for charging characteristics in the same manner as in Example 1 but employing positive charge potentials.

$V_{\alpha}$: +690V $E_{\frac{1}{2}}$: 1.9 lux.sec

What is claimed is:

1. An electrophotographic photosensitive member, comprising an electroconductive support and a photosensitive layer formed thereon, said photosensitive layer containing a compound represented by the following general Formula (1):

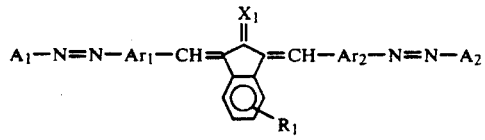

(1)

wherein $Ar_1$ and $Ar_2$, which may be the same or different, are each a carbocyclic aromatic group or a heterocyclic aromatic group which is unsubstituted or substituted with a substituent selected from the group consisting of halogen, alkyl, alkoxy, aryloxy, nitro, cyano and substituted amino; $X_1$ is a sulfur atom or a dicyanomethylene group; $R_1$ is a hydrogen atom, a halogen atom, a nitro group, a cyano group, a substituted or unsubstituted alkyl group, a substituted or unsubstituted aryl group, a substituted or unsubstituted aralkyl, a substituted or unsubstituted alkoxy, or a substituted or unsubstituted aryloxy; $A_1$ and $A_2$, which may be the same or different, are each a coupler residue having a phenolic hydroxyl group.

2. An electrophotographic photosensitive member according to claim 1, wherein said groups of $A_1$ and $A_2$ each represent any one of the groups of Formulas (2) to (8):

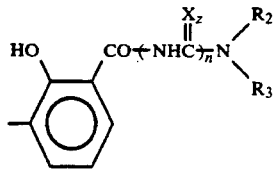

(2)

$Y_1$ (n = 0 or 1)

wherein $Y_1$ is a group of atoms for forming a condensed polycyclic aromatic ring or a heterocyclic ring; $X_2$ is an oxygen atom or a sulfur atom; $R_2$ and $R_3$ are each independently a hydrogen atom, or a substituted or unsubstituted alkyl group, a substituted or unsubstituted aryl group, a substituted or unsubstituted aralkyl group, or a substituted or unsubstituted heterocyclic group, or $R_2$ and $R_3$ may be linked to form a cyclic amino group together with the nitrogen atom in the formula;

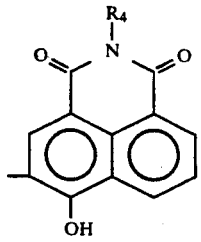

(3)

wherein $R_4$ is a substituted or unsubstituted group of alkyl, aryl, or aralkyl;

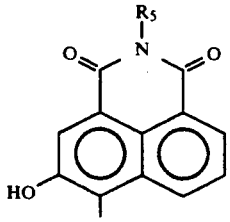

(4)

wherein $R_5$ is a substituted or unsubstituted group of alkyl, aryl, or aralkyl;

$Z_1$

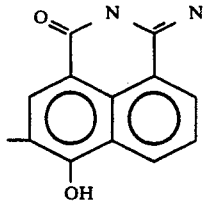

(5)

wherein $Z_1$ is a divalent aromatic hydrocarbon group or a divalent group for forming a heterocyclic ring together with the two nitrogen atoms in the formula;

$Z_2$

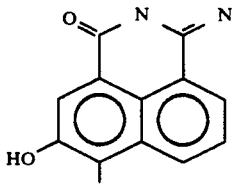

(6)

wherein $Z_2$ is a divalent aromatic hydrocarbon group or a group for forming a divalent heterocyclic ring radical together with the two nitrogen atoms in the formula;

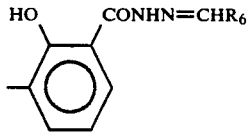

(7)

$Y_2$ wherein $R_6$ is a substituted or unsubstituted aryl or a heterocyclic ring group; $Y_2$ is a group of atoms for forming a condensed polycyclic aromatic ring, or a heterocyclic ring;

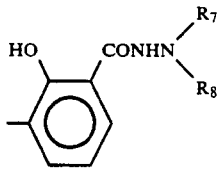

(8)

$Y_3$ wherein $R_7$ and $R_8$, which may be the same or different, are each a substituted or unsubstituted alkyl group, a substituted or unsubstituted aryl group, a substituted or unsubstituted aralkyl group, or a substituted or unsubstituted heterocyclic group; or $R_7$ and $R_8$ may be linked to form a cyclic amino group together with the nitrogen atom in the formula; $Y_3$ is a group of atoms for forming a condensed polycyclic aromatic ring, or a heterocyclic ring together with the benzene ring in the formula.

3. An electrophotographic photosensitive member according to claim 1, wherein the photosensitive layer comprises a charge-generating layer and a charge-transporting layer.

4. An electrophotographic photosensitive member according to claim 3, wherein the charge-transporting layer is overlaid on the charge-generating layer.

5. An electrophotographic photosensitive member according to claim 4, wherein the charge-generating layer is overlaid on the charge-transporting layer.

6. An electrophotographic photosensitive member according to claim 1, wherein the photosensitive layer is constituted of a single layer.

7. An electrophotographic photosensitive member according to claim 1, wherein a subbing layer is provided between the electroconductive support and the photosensitive layer.

8. An electrophotographic photosensitive member according to claim 1, wherein a protective layer is provided on the photosensitive layer.

* * * * *

UNITED STATES PATENT AND TRADEMARK OFFICE

CERTIFICATE OF CORRECTION

PATENT NO. :5,246,805

DATED :September 21, 1993

INVENTOR(S) :HAJIME MIYAZAKI, ET AL.

It is certified that error appears in the above-indentified patent and that said Letters Patent is hereby corrected as shown below:

IN [57] ABSTRACT

Line 6, "provide" should read --provides--.

COLUMN 1

Line 18, "Related" should read --2. Related--.
Line 30, "produced" should read --be produced--.

COLUMN 3

Formula (2),

" 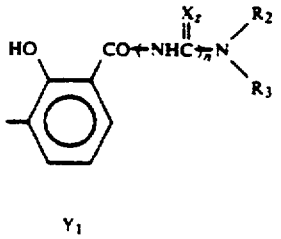 " should read -- 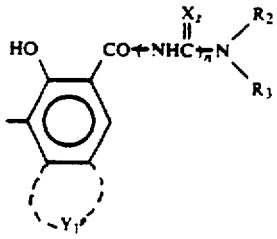 --.

COLUMN 4

Formula (5),

" 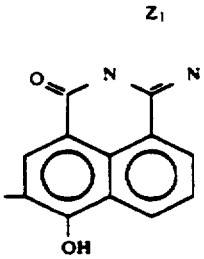 " should read -- 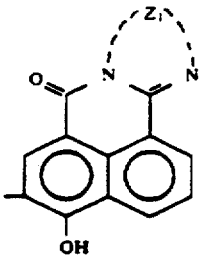 --.

UNITED STATES PATENT AND TRADEMARK OFFICE

CERTIFICATE OF CORRECTION

PATENT NO. : 5,246,805

DATED : September 21, 1993

INVENTOR(S) : HAJIME MIYAZAKI, ET AL.

It is certified that error appears in the above-indentified patent and that said Letters Patent is hereby corrected as shown below:

COLUMN 4

Line 59, "divalent a" should read --a divalent--.
Line 62, "naphthalene peri-naphthalene" should read --naphthalene, peri-naphthalene,--.

COLUMN 5

Formula (6),

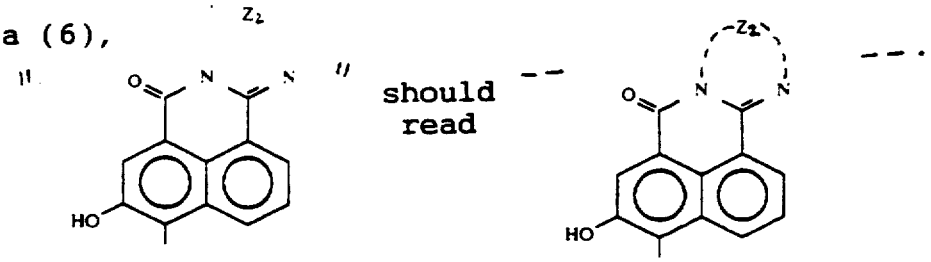

Formula (7),

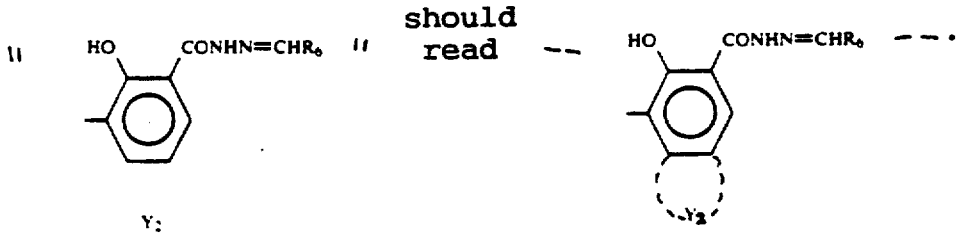

UNITED STATES PATENT AND TRADEMARK OFFICE

CERTIFICATE OF CORRECTION

PATENT NO. : 5,246,805

DATED : September 21, 1993

INVENTOR(S) : HAJIME MIYAZAKI, ET AL.

It is certified that error appears in the above-indentified patent and that said Letters Patent is hereby corrected as shown below:

COLUMN 5

Formula (8),

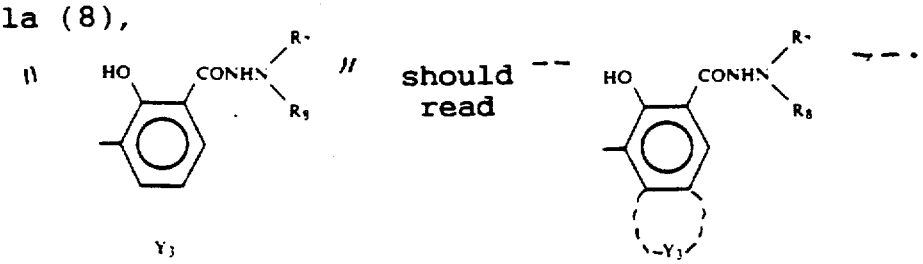

COLUMN 23

Line 17, "$Ar_1$: $Ar_2$:" should read --$Ar_1$, $Ar_2$:--.

COLUMN 37

Line 35, "nitride" should read --nitrite--.
Line 50, "surely" should be deleted.

COLUMN 39

Line 31, "does" should read --do--.
Line 62, "hyde-N,N, and" should read --hyde-N,N-diphenylhydrazone, and--.

COLUMN 41

Line 22, "elctrostatic" should read --electrostatic--.
Line 37, "un-transferred" should read --untransferred--.
Line 38, "for" (first occurrence) should read --with--.
Line 51, "on" should read --one--.

UNITED STATES PATENT AND TRADEMARK OFFICE

CERTIFICATE OF CORRECTION

PATENT NO. :5,246,805

DATED :September 21, 1993

INVENTOR(S) :HAJIME MIYAZAKI, ET AL.

It is certified that error appears in the above-indentified patent and that said Letters Patent is hereby corrected as shown below:

COLUMN 42

Line 26, "Incidentally" should read --Incidentally,--.

COLUMN 43

"Comparative example (C)" should read --Comparative pigment (C)--.

COLUMN 44

Line 19, "Comparative examples 1-6" should read --COMPARATIVE EXAMPLES 1-6--.

COLUMN 45

"Comparative example (F)" should read --Comparative pigment (F)--.

Line 57, "sticked" should read --affixed--.

COLUMN 48

Line 17, "a" should read --an--.

UNITED STATES PATENT AND TRADEMARK OFFICE

CERTIFICATE OF CORRECTION

PATENT NO. : 5,246,805

DATED : September 21, 1993

INVENTOR(S) : HAJIME MIYAZAKI, ET AL.

It is certified that error appears in the above-indentified patent and that said Letters Patent is hereby corrected as shown below:

COLUMN 49

Formula (2),

" 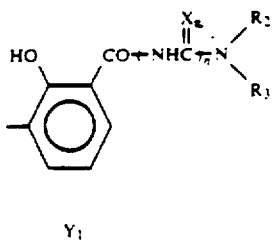 " should read -- 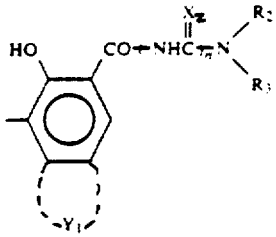 --.

COLUMN 50

Formula (5),

" 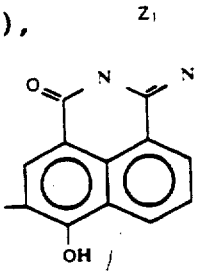 " should read -- 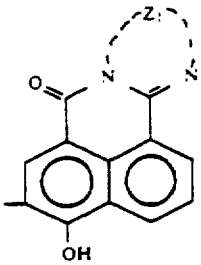 --.

Formula (6),

" 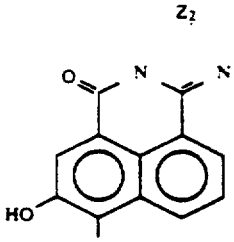 " should read -- 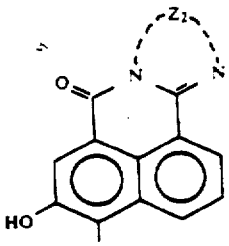 --.

UNITED STATES PATENT AND TRADEMARK OFFICE

CERTIFICATE OF CORRECTION

PATENT NO. :5,246,805

DATED :September 21, 1993

INVENTOR(S) :HAJIME MIYAZAKI, ET AL.

It is certified that error appears in the above-indentified patent and that said Letters Patent is hereby corrected as shown below:

COLUMN 50

Formula (7),

" 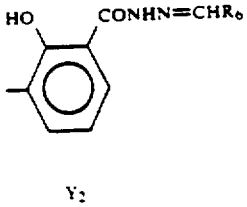

" should read -- 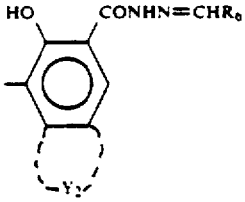

--.

Formula (8),

" 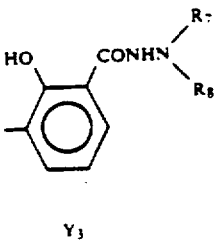

" should read -- 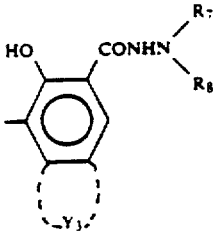

--.

UNITED STATES PATENT AND TRADEMARK OFFICE

CERTIFICATE OF CORRECTION

PATENT NO. :5,246,805

DATED :September 21, 1993

INVENTOR(S) :HAJIME MIYAZAKI, ET AL.

It is certified that error appears in the above-indentified patent and that said Letters Patent is hereby corrected as shown below:

COLUMN 51

Line 9, "claim 4," should read --claim 3,--.

Signed and Sealed this

Thirteenth Day of September, 1994

*Attest:*

*Attesting Officer*

BRUCE LEHMAN

*Commissioner of Patents and Trademarks*